US010373554B2

(12) United States Patent
Chaji et al.

(10) Patent No.: US 10,373,554 B2
(45) **Date of Patent: *Aug. 6, 2019**

(54) PIXELS AND REFERENCE CIRCUITS AND TIMING TECHNIQUES

(71) Applicant: Ignis Innovation Inc., Waterloo (CA)

(72) Inventors: Gholamreza Chaji, Waterloo (CA); Yaser Azizi, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 213 days.

This patent is subject to a terminal disclaimer.

(21) Appl. No.: 15/361,660

(22) Filed: Nov. 28, 2016

(65) Prior Publication Data

US 2017/0076670 A1 Mar. 16, 2017

Related U.S. Application Data

(63) Continuation-in-part of application No. 15/215,036, filed on Jul. 20, 2016.

(30) Foreign Application Priority Data

Jul. 24, 2015 (CA) ..... 2898282

(51) Int. Cl.
*G09G 3/3233* (2016.01)

(52) U.S. Cl.
CPC ... *G09G 3/3233* (2013.01); *G09G 2300/0819* (2013.01); *G09G 2310/08* (2013.01); *G09G 2320/0233* (2013.01); *G09G 2320/045* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009 (3 pages).
(Continued)

*Primary Examiner* — Joseph R Haley
*Assistant Examiner* — Emily J Frank
(74) *Attorney, Agent, or Firm* — Stratford Managers Corporation

(57) ABSTRACT

What is disclosed are systems and methods of compensation of images produced by active matrix light emitting diode device (AMOLED) and other emissive displays. Anomalies in luminance produced by pixel circuits and bias currents produced by current biasing circuits for driving current biased voltage programmed pixels are corrected through calibration and compensation while re-using existing data or other lines that can be controlled individually to perform said calibration and compensation.

16 Claims, 18 Drawing Sheets

(56) References Cited

U.S. PATENT DOCUMENTS 3,774,055 A 11/1973 Bapat et al.
4,090,096 A 5/1978 Nagami
4,354,162 A 10/1982 Wright
4,758,831 A 7/1988 Kasahara et al.
4,963,860 A 10/1990 Stewart
4,975,691 A 12/1990 Lee
4,996,523 A 2/1991 Bell et al.
5,051,739 A 9/1991 Hayashida et al.
5,134,387 A 7/1992 Smith et al.
5,153,420 A 10/1992 Hack et al.
5,170,158 A 12/1992 Shinya
5,204,661 A 4/1993 Hack et al.
5,222,082 A 6/1993 Plus
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,684,365 A 11/1997 Tang et al.
5,686,935 A 11/1997 Weisbrod
5,691,783 A 11/1997 Numao et al.
5,701,505 A 12/1997 Yamashita et al.
5,712,653 A 1/1998 Katoh et al.
5,714,968 A 2/1998 Ikeda
5,744,824 A 4/1998 Kousai et al.
5,745,660 A 4/1998 Kolpatzik et al.
5,747,928 A 5/1998 Shanks et al.
5,748,160 A 5/1998 Shieh et al.
5,758,129 A 5/1998 Gray et al.
5,784,042 A 7/1998 Ono et al.
5,790,234 A 8/1998 Matsuyama
5,815,303 A 9/1998 Berlin
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,081,131 A 6/2000 Ishii
6,091,203 A 7/2000 Kawashima et al.
6,097,360 A 8/2000 Holloman
6,100,868 A 8/2000 Lee et al.
6,144,222 A 11/2000 Ho
6,157,583 A 12/2000 Starnes et al.
6,166,489 A 12/2000 Thompson et al.
6,177,915 B1 1/2001 Beeteson et al.
6,225,846 B1 5/2001 Wada et al.
6,229,506 B1 5/2001 Dawson et al.
6,229,508 B1 5/2001 Kane
6,232,939 B1 5/2001 Saito et al.
6,246,180 B1 6/2001 Nishigaki
6,252,248 B1 6/2001 Sano et al.
6,259,424 B1 7/2001 Kurogane
6,268,841 B1 7/2001 Cairns et al.
6,274,887 B1 8/2001 Yamazaki et al.
6,288,696 B1 9/2001 Holloman
6,300,928 B1 10/2001 Kim
6,303,963 B1 10/2001 Ohtani et al.
6,306,694 B1 10/2001 Yamazaki et al.
6,307,322 B1 10/2001 Dawson et al.
6,310,962 B1 10/2001 Chung et al.
6,316,786 B1 11/2001 Mueller et al.
6,320,325 B1 11/2001 Cok et al.
6,323,631 B1 11/2001 Juang
6,323,832 B1 11/2001 Nishizawa et al.
6,333,729 B1 12/2001 Ha
6,345,085 B1 2/2002 Yeo et al.
6,348,835 B1 2/2002 Sato et al.
6,365,917 B1 4/2002 Yamazaki
6,373,453 B1 4/2002 Yudasaka
6,384,427 B1 5/2002 Yamazaki et al.
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,399,988 B1 6/2002 Yamazaki
6,414,661 B1 7/2002 Shen et al.
6,417,825 B1 7/2002 Stewart et al.
6,420,758 B1 7/2002 Nakajima
6,420,834 B2 7/2002 Yamazaki et al.
6,420,988 B1 7/2002 Azami et al.
6,430,496 B1 8/2002 Smith et al.
6,433,488 B1 8/2002 Bu
6,445,376 B2 9/2002 Parrish
6,468,638 B2 10/2002 Jacobsen et al.
6,473,065 B1 10/2002 Fan
6,475,845 B2 11/2002 Kimura
6,489,952 B1 12/2002 Tanaka et al.
6,501,098 B2 12/2002 Yamazaki
6,501,466 B1 12/2002 Yamagashi et al.
6,512,271 B1 1/2003 Yamazaki et al.
6,518,594 B1 2/2003 Nakajima et al.
6,522,315 B2 2/2003 Ozawa et al.
6,524,895 B2 2/2003 Yamazaki et al.
6,531,713 B1 3/2003 Yamazaki
6,535,185 B2 3/2003 Kim et al.
6,542,138 B1 4/2003 Shannon et al.
6,559,594 B2 5/2003 Fukunaga et al.
6,559,839 B1 5/2003 Ueno et al.
6,573,195 B1 6/2003 Yamazaki et al.
6,573,584 B1 6/2003 Nagakari et al.
6,576,926 B1 6/2003 Yamazaki et al.
6,577,302 B2 6/2003 Hunter
6,580,408 B1 6/2003 Bae et al.
6,580,657 B2 6/2003 Sanford et al.
6,583,398 B2 6/2003 Harkin
6,583,775 B1 6/2003 Sekiya et al.
6,583,776 B2 6/2003 Yamazaki et al.
6,587,086 B1 7/2003 Koyama
6,593,691 B2 7/2003 Nishi et al.
6,594,606 B2 7/2003 Everitt
6,597,203 B2 7/2003 Forbes
6,611,108 B2 8/2003 Kimura
6,617,644 B1 9/2003 Yamazaki et al.
6,618,030 B2 9/2003 Kane et al.
6,639,244 B1 10/2003 Yamazaki et al.
6,641,933 B1 11/2003 Yamazaki et al.
6,661,180 B2 12/2003 Koyama
6,661,397 B2 12/2003 Mikami et al.
6,670,637 B2 12/2003 Yamazaki et al.
6,677,713 B1 1/2004 Sung
6,680,577 B1 1/2004 Inukai et al.
6,680,580 B1 1/2004 Sung
6,686,699 B2 2/2004 Yumoto
6,687,266 B1 2/2004 Ma et al.
6,690,000 B1 2/2004 Muramatsu et al.
6,690,344 B1 2/2004 Takeuchi et al.
6,693,388 B2 2/2004 Oomura
6,693,610 B2 2/2004 Shannon et al.
6,694,248 B2 2/2004 Smith et al.
6,697,057 B2 2/2004 Koyama et al.
6,720,942 B2 4/2004 Lee et al.
6,724,151 B2 4/2004 Yoo
6,734,636 B2 5/2004 Sanford et al.
6,738,034 B2 5/2004 Kaneko et al.
6,738,035 B1 5/2004 Fan
6,753,655 B2 6/2004 Shih et al.
6,753,834 B2 6/2004 Mikami et al.
6,756,741 B2 6/2004 Li
6,756,958 B2 6/2004 Furuhashi et al.
6,771,028 B1 8/2004 Winters
6,777,712 B2 8/2004 Sanford et al.
6,777,888 B2 8/2004 Kondo
6,780,687 B2 8/2004 Nakajima et al.

(56) References Cited

U.S. PATENT DOCUMENTS

| | | | |
|---|---|---|---|
| 6,781,567 | B2 | 8/2004 | Kimura |
| 6,788,231 | B1 | 9/2004 | Hsueh |
| 6,806,638 | B2 | 10/2004 | Lih et al. |
| 6,806,857 | B2 | 10/2004 | Sempel et al. |
| 6,809,706 | B2 | 10/2004 | Shimoda |
| 6,828,950 | B2 | 12/2004 | Koyama |
| 6,858,991 | B2 | 2/2005 | Miyazawa |
| 6,859,193 | B1 | 2/2005 | Yumoto |
| 6,861,670 | B1 | 3/2005 | Ohtani et al. |
| 6,873,117 | B2 | 3/2005 | Ishizuka |
| 6,873,320 | B2 | 3/2005 | Nakamura |
| 6,876,346 | B2 | 4/2005 | Anzai et al. |
| 6,878,968 | B1 | 4/2005 | Ohnuma |
| 6,900,485 | B2 | 5/2005 | Lee |
| 6,903,734 | B2 | 6/2005 | Eu |
| 6,909,114 | B1 | 6/2005 | Yamazaki |
| 6,909,419 | B2 | 6/2005 | Zavracky et al. |
| 6,911,960 | B1 | 6/2005 | Yokoyama |
| 6,911,964 | B2 | 6/2005 | Lee et al. |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura et al. |
| 6,940,214 | B1 | 9/2005 | Komiya et al. |
| 6,943,500 | B2 | 9/2005 | LeChevalier |
| 6,954,194 | B2 | 10/2005 | Matsumoto et al. |
| 6,956,547 | B2 | 10/2005 | Bae et al. |
| 6,970,149 | B2 | 11/2005 | Chung et al. |
| 6,975,142 | B2 | 12/2005 | Azami et al. |
| 6,975,332 | B2 | 12/2005 | Arnold et al. |
| 6,995,510 | B2 | 2/2006 | Murakami et al. |
| 6,995,519 | B2 | 2/2006 | Arnold et al. |
| 7,022,556 | B1 | 4/2006 | Adachi |
| 7,023,408 | B2 | 4/2006 | Chen et al. |
| 7,027,015 | B2 | 4/2006 | Booth, Jr. et al. |
| 7,034,793 | B2 | 4/2006 | Sekiya et al. |
| 7,038,392 | B2 | 5/2006 | Libsch et al. |
| 7,057,588 | B2 | 6/2006 | Asano et al. |
| 7,061,451 | B2 | 6/2006 | Kimura |
| 7,071,932 | B2 | 7/2006 | Libsch et al. |
| 7,088,051 | B1 | 8/2006 | Cok |
| 7,106,285 | B2 | 9/2006 | Naugler |
| 7,112,820 | B2 | 9/2006 | Chang et al. |
| 7,113,864 | B2 | 9/2006 | Smith et al. |
| 7,116,058 | B2 | 10/2006 | Lo et al. |
| 7,122,835 | B1 | 10/2006 | Ikeda et al. |
| 7,129,914 | B2 | 10/2006 | Knapp et al. |
| 7,129,917 | B2 | 10/2006 | Yamazaki et al. |
| 7,141,821 | B1 | 11/2006 | Yamazaki et al. |
| 7,161,566 | B2 | 1/2007 | Cok et al. |
| 7,164,417 | B2 | 1/2007 | Cok |
| 7,193,589 | B2 | 3/2007 | Yoshida et al. |
| 7,199,516 | B2 | 4/2007 | Seo et al. |
| 7,220,997 | B2 | 5/2007 | Nakata |
| 7,224,332 | B2 | 5/2007 | Cok |
| 7,235,810 | B1 | 6/2007 | Yamazaki et al. |
| 7,245,277 | B2 | 7/2007 | Ishizuka |
| 7,248,236 | B2 | 7/2007 | Nathan et al. |
| 7,259,737 | B2 | 8/2007 | Ono et al. |
| 7,262,753 | B2 | 8/2007 | Tanghe et al. |
| 7,264,979 | B2 | 9/2007 | Yamagata et al. |
| 7,274,345 | B2 | 9/2007 | Imamura et al. |
| 7,274,363 | B2 | 9/2007 | Ishizuka et al. |
| 7,279,711 | B1 | 10/2007 | Yamazaki et al. |
| 7,304,621 | B2 | 12/2007 | Oomori et al. |
| 7,310,092 | B2 | 12/2007 | Imamura |
| 7,315,295 | B2 | 1/2008 | Kimura |
| 7,317,429 | B2 | 1/2008 | Shirasaki et al. |
| 7,317,434 | B2 | 1/2008 | Lan et al. |
| 7,319,465 | B2 | 1/2008 | Mikami et al. |
| 7,321,348 | B2 | 1/2008 | Cok et al. |
| 7,327,357 | B2 | 2/2008 | Jeong |
| 7,333,077 | B2 | 2/2008 | Koyama et al. |
| 7,339,636 | B2 | 3/2008 | Voloschenko et al. |
| 7,343,243 | B2 | 3/2008 | Smith et al. |
| 7,355,574 | B1 | 4/2008 | Leon et al. |
| 7,358,941 | B2 | 4/2008 | Ono et al. |
| 7,402,467 | B1 | 7/2008 | Kadono et al. |
| 7,414,600 | B2 | 8/2008 | Nathan et al. |
| 7,432,885 | B2 | 10/2008 | Asano et al. |
| 7,466,166 | B2 | 12/2008 | Date et al. |
| 7,474,285 | B2 | 1/2009 | Kimura |
| 7,485,478 | B2 | 2/2009 | Yamagata et al. |
| 7,495,501 | B2 | 2/2009 | Iwabuchi et al. |
| 7,502,000 | B2 | 3/2009 | Yuki et al. |
| 7,515,124 | B2 | 4/2009 | Yaguma et al. |
| 7,535,449 | B2 | 5/2009 | Miyazawa |
| 7,554,512 | B2 | 6/2009 | Steer |
| 7,569,849 | B2 | 8/2009 | Nathan et al. |
| 7,595,776 | B2 | 9/2009 | Hashimoto et al. |
| 7,604,718 | B2 | 10/2009 | Zhang et al. |
| 7,609,239 | B2 | 10/2009 | Chang |
| 7,612,745 | B2 | 11/2009 | Yumoto et al. |
| 7,619,594 | B2 | 11/2009 | Hu |
| 7,619,597 | B2 | 11/2009 | Nathan et al. |
| 7,639,211 | B2 | 12/2009 | Miyazawa |
| 7,683,899 | B2 | 3/2010 | Hirakata et al. |
| 7,688,289 | B2 | 3/2010 | Abe et al. |
| 7,697,052 | B1 | 4/2010 | Yamazaki et al. |
| 7,760,162 | B2 | 7/2010 | Miyazawa |
| 7,808,008 | B2 | 10/2010 | Miyake |
| 7,825,419 | B2 | 11/2010 | Yamagata et al. |
| 7,859,492 | B2 | 12/2010 | Kohno |
| 7,859,520 | B2 | 12/2010 | Kimura |
| 7,868,859 | B2 | 1/2011 | Tomida et al. |
| 7,876,294 | B2 | 1/2011 | Sasaki et al. |
| 7,889,159 | B2 | 2/2011 | Nathan et al. |
| 7,903,127 | B2 | 3/2011 | Kwon |
| 7,920,116 | B2 | 4/2011 | Woo et al. |
| 7,944,414 | B2 | 5/2011 | Shirasaki et al. |
| 7,948,170 | B2 | 5/2011 | Striakhilev et al. |
| 7,969,390 | B2 | 6/2011 | Yoshida |
| 7,978,170 | B2 | 7/2011 | Park et al. |
| 7,989,392 | B2 | 8/2011 | Crockett et al. |
| 7,995,008 | B2 | 8/2011 | Miwa |
| 7,995,010 | B2 | 8/2011 | Yamazaki et al. |
| 8,044,893 | B2 | 10/2011 | Nathan et al. |
| 8,063,852 | B2 | 11/2011 | Kwak et al. |
| 8,102,343 | B2 | 1/2012 | Yatabe |
| 8,115,707 | B2 | 2/2012 | Nathan et al. |
| 8,144,081 | B2 | 3/2012 | Miyazawa |
| 8,159,007 | B2 | 4/2012 | Bama et al. |
| 8,242,979 | B2 | 8/2012 | Anzai et al. |
| 8,253,665 | B2 | 8/2012 | Nathan et al. |
| 8,283,967 | B2 | 10/2012 | Chaji et al. |
| 8,319,712 | B2 | 11/2012 | Nathan et al. |
| 8,378,362 | B2 | 2/2013 | Heo et al. |
| 8,493,295 | B2 | 7/2013 | Yamazaki et al. |
| 8,497,525 | B2 | 7/2013 | Yamagata et al. |
| 8,564,513 | B2 | 10/2013 | Nathan et al. |
| 8,872,739 | B2 | 10/2014 | Kimura |
| 2001/0002703 | A1 | 6/2001 | Koyama |
| 2001/0004190 | A1 | 6/2001 | Nishi et al. |
| 2001/0009283 | A1 | 7/2001 | Arao et al. |
| 2001/0013806 | A1 | 8/2001 | Notani |
| 2001/0015653 | A1 | 8/2001 | De Jong et al. |
| 2001/0020926 | A1 | 9/2001 | Kujik |
| 2001/0024186 | A1 | 9/2001 | Kane et al. |
| 2001/0026127 | A1 | 10/2001 | Yoneda et al. |
| 2001/0026179 | A1 | 10/2001 | Saeki |
| 2001/0026257 | A1 | 10/2001 | Kimura |
| 2001/0030323 | A1 | 10/2001 | Ikeda |
| 2001/0033199 | A1 | 10/2001 | Aoki |
| 2001/0035863 | A1 | 11/2001 | Kimura |
| 2001/0038098 | A1 | 11/2001 | Yamazaki et al. |
| 2001/0040541 | A1 | 11/2001 | Yoneda et al. |
| 2001/0043173 | A1 | 11/2001 | Troutman |
| 2001/0045929 | A1 | 11/2001 | Prache et al. |
| 2001/0052606 | A1 | 12/2001 | Sempel et al. |
| 2001/0052898 | A1 | 12/2001 | Osame et al. |
| 2001/0052940 | A1 | 12/2001 | Hagihara et al. |
| 2002/0000576 | A1 | 1/2002 | Inukai |
| 2002/0011796 | A1 | 1/2002 | Koyama |

(56) References Cited

U.S. PATENT DOCUMENTS

2002/0011799 A1 1/2002 Kimura
2002/0011981 A1 1/2002 Kujik
2002/0012057 A1 1/2002 Kimura
2002/0015031 A1 2/2002 Fujita et al.
2002/0015032 A1 2/2002 Koyama et al.
2002/0030190 A1 3/2002 Ohtani et al.
2002/0030528 A1 3/2002 Matsumoto et al.
2002/0030647 A1 3/2002 Hack et al.
2002/0036463 A1 3/2002 Yoneda et al.
2002/0047565 A1 4/2002 Nara et al.
2002/0047852 A1 4/2002 Inukai et al.
2002/0048829 A1 4/2002 Yamazaki et al.
2002/0050795 A1 5/2002 Imura
2002/0052086 A1 5/2002 Maeda
2002/0053401 A1 5/2002 Ishikawa et al.
2002/0070909 A1 6/2002 Asano et al.
2002/0080108 A1 6/2002 Wang
2002/0084463 A1 7/2002 Sanford et al.
2002/0101172 A1 8/2002 Bu
2002/0101433 A1 8/2002 McKnight
2002/0113248 A1 8/2002 Yamagata et al.
2002/0117722 A1 8/2002 Osada et al.
2002/0122308 A1 9/2002 Ikeda
2002/0130686 A1 9/2002 Forbes
2002/0140712 A1 10/2002 Ouchi et al.
2002/0154084 A1 10/2002 Tanaka et al.
2002/0158587 A1 10/2002 Komiya
2002/0158666 A1 10/2002 Azami et al.
2002/0158823 A1 10/2002 Zavracky et al.
2002/0163314 A1 11/2002 Yamazaki et al.
2002/0167471 A1 11/2002 Everitt
2002/0171613 A1 11/2002 Goto et al.
2002/0180369 A1 12/2002 Koyama
2002/0180721 A1 12/2002 Kimura et al.
2002/0181275 A1 12/2002 Yamazaki
2002/0186214 A1 12/2002 Siwinski
2002/0190332 A1 12/2002 Lee et al.
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2002/0196213 A1 12/2002 Akimoto et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0063081 A1 4/2003 Kimura et al.
2003/0071804 A1 4/2003 Yamazaki et al.
2003/0071821 A1 4/2003 Sundahl
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122745 A1 7/2003 Miyazawa
2003/0122747 A1 7/2003 Shannon et al.
2003/0128199 A1 7/2003 Kimura
2003/0140958 A1 7/2003 Yang et al.
2003/0151569 A1 8/2003 Lee et al.
2003/0156104 A1 8/2003 Morita
2003/0169219 A1 9/2003 LeChevalier
2003/0169241 A1 9/2003 LeChevalier
2003/0169247 A1 9/2003 Kawabe et al.
2003/0174152 A1 9/2003 Noguchi
2003/0178617 A1 9/2003 Appenzeller et al.
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0206060 A1 11/2003 Suzuki
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0027063 A1 2/2004 Nishikawa
2004/0032382 A1 2/2004 Cok et al.
2004/0041750 A1 3/2004 Abe
2004/0056604 A1 3/2004 Shih et al.
2004/0066357 A1 4/2004 Kawasaki
2004/0070557 A1 4/2004 Asano et al.
2004/0070558 A1 4/2004 Cok
2004/0080262 A1 4/2004 Park et al.
2004/0080470 A1 4/2004 Yamazaki et al.
2004/0090186 A1 5/2004 Yoshida et al.
2004/0090400 A1 5/2004 Yoo
2004/0095338 A1 5/2004 Takashi
2004/0108518 A1 6/2004 Jo
2004/0113903 A1 6/2004 Mikami et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0171619 A1 9/2004 Barkoczy et al.
2004/0174347 A1 9/2004 Sun et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0201554 A1 10/2004 Satoh
2004/0207615 A1 10/2004 Yumoto
2004/0227697 A1 11/2004 Mori
2004/0233125 A1 11/2004 Tanghe et al.
2004/0239596 A1 12/2004 Ono et al.
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0030267 A1 2/2005 Tanghe et al.
2005/0035709 A1 2/2005 Furuie et al.
2005/0041002 A1* 2/2005 Takahara ..... G09G 3/3241 345/76
2005/0052379 A1 3/2005 Waterman
2005/0057459 A1 3/2005 Miyazawa
2005/0067970 A1 3/2005 Libsch et al.
2005/0067971 A1 3/2005 Kane
2005/0068270 A1 3/2005 Awakura
2005/0083270 A1 4/2005 Miyazawa
2005/0088085 A1 4/2005 Nishikawa et al.
2005/0088103 A1 4/2005 Kageyama et al.
2005/0110420 A1 5/2005 Arnold et al.
2005/0110727 A1 5/2005 Shin
2005/0117096 A1 6/2005 Voloschenko et al.
2005/0123193 A1 6/2005 Lamberg et al.
2005/0140598 A1 6/2005 Kim et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.

(56) References Cited

U.S. PATENT DOCUMENTS

| | | | |
|---|---|---|---|
| 2005/0225686 | A1 | 10/2005 | Brummack et al. |
| 2005/0243037 | A1 | 11/2005 | Eom et al. |
| 2005/0248515 | A1 | 11/2005 | Naugler et al. |
| 2005/0258867 | A1 | 11/2005 | Miyazawa |
| 2005/0260777 | A1 | 11/2005 | Brabec et al. |
| 2005/0269959 | A1 | 12/2005 | Uchino et al. |
| 2005/0269960 | A1 | 12/2005 | Ono et al. |
| 2005/0285822 | A1 | 12/2005 | Reddy et al. |
| 2005/0285825 | A1 | 12/2005 | Eom et al. |
| 2006/0007072 | A1 | 1/2006 | Choi et al. |
| 2006/0012310 | A1 | 1/2006 | Chen et al. |
| 2006/0012311 | A1 | 1/2006 | Ogawa |
| 2006/0022305 | A1 | 2/2006 | Yamashita |
| 2006/0027807 | A1 | 2/2006 | Nathan et al. |
| 2006/0030084 | A1 | 2/2006 | Young |
| 2006/0038750 | A1 | 2/2006 | Inoue et al. |
| 2006/0038758 | A1 | 2/2006 | Routley et al. |
| 2006/0038762 | A1 | 2/2006 | Chou |
| 2006/0044227 | A1 | 3/2006 | Hadcock |
| 2006/0066527 | A1 | 3/2006 | Chou |
| 2006/0066533 | A1 | 3/2006 | Sato et al. |
| 2006/0077077 | A1 | 4/2006 | Kwon |
| 2006/0077134 | A1 | 4/2006 | Hector |
| 2006/0077194 | A1 | 4/2006 | Jeong |
| 2006/0092185 | A1 | 5/2006 | Jo et al. |
| 2006/0114196 | A1 | 6/2006 | Shin |
| 2006/0125408 | A1 | 6/2006 | Nathan et al. |
| 2006/0125740 | A1 | 6/2006 | Shirasaki et al. |
| 2006/0139253 | A1 | 6/2006 | Choi et al. |
| 2006/0145964 | A1 | 7/2006 | Park et al. |
| 2006/0158402 | A1 | 7/2006 | Nathan |
| 2006/0191178 | A1 | 8/2006 | Sempel et al. |
| 2006/0208971 | A1 | 9/2006 | Deane |
| 2006/0209012 | A1 | 9/2006 | Hagood, IV |
| 2006/0214888 | A1 | 9/2006 | Schneider et al. |
| 2006/0221009 | A1 | 10/2006 | Miwa |
| 2006/0227082 | A1 | 10/2006 | Ogata et al. |
| 2006/0232522 | A1 | 10/2006 | Roy et al. |
| 2006/0244391 | A1 | 11/2006 | Shishido et al. |
| 2006/0244697 | A1 | 11/2006 | Lee et al. |
| 2006/0261841 | A1 | 11/2006 | Fish |
| 2006/0264143 | A1 | 11/2006 | Lee et al. |
| 2006/0273997 | A1 | 12/2006 | Nathan et al. |
| 2006/0279478 | A1 | 12/2006 | Ikegami |
| 2006/0284801 | A1 | 12/2006 | Yoon et al. |
| 2006/0290614 | A1 | 12/2006 | Nathan et al. |
| 2007/0001937 | A1 | 1/2007 | Park et al. |
| 2007/0001939 | A1 | 1/2007 | Hashimoto et al. |
| 2007/0001945 | A1 | 1/2007 | Yoshida et al. |
| 2007/0008251 | A1 | 1/2007 | Kohno et al. |
| 2007/0008268 | A1 | 1/2007 | Park et al. |
| 2007/0008297 | A1 | 1/2007 | Bassetti |
| 2007/0035489 | A1 | 2/2007 | Lee |
| 2007/0035707 | A1 | 2/2007 | Margulis |
| 2007/0040773 | A1 | 2/2007 | Lee et al. |
| 2007/0040782 | A1 | 2/2007 | Woo et al. |
| 2007/0046195 | A1 | 3/2007 | Chin et al. |
| 2007/0057873 | A1 | 3/2007 | Uchino et al. |
| 2007/0057874 | A1 | 3/2007 | Le Roy et al. |
| 2007/0063932 | A1 | 3/2007 | Nathan et al. |
| 2007/0069998 | A1 | 3/2007 | Naugler et al. |
| 2007/0075957 | A1 | 4/2007 | Chen |
| 2007/0080905 | A1 | 4/2007 | Takahara |
| 2007/0080906 | A1 | 4/2007 | Tanabe |
| 2007/0080908 | A1 | 4/2007 | Nathan et al. |
| 2007/0080918 | A1 | 4/2007 | Kawachi et al. |
| 2007/0085801 | A1 | 4/2007 | Park et al. |
| 2007/0103419 | A1 | 5/2007 | Uchino et al. |
| 2007/0109232 | A1 | 5/2007 | Yamamoto et al. |
| 2007/0128583 | A1 | 6/2007 | Miyazawa |
| 2007/0164941 | A1 | 7/2007 | Park et al. |
| 2007/0182671 | A1 | 8/2007 | Nathan et al. |
| 2007/0236430 | A1 | 10/2007 | Fish |
| 2007/0236440 | A1 | 10/2007 | Wacyk et al. |
| 2007/0241999 | A1 | 10/2007 | Lin |
| 2007/0242008 | A1 | 10/2007 | Cummings |
| 2007/0273294 | A1 | 11/2007 | Nagayama |
| 2007/0285359 | A1 | 12/2007 | Ono |
| 2007/0296672 | A1 | 12/2007 | Kim et al. |
| 2008/0001544 | A1 | 1/2008 | Murakami et al. |
| 2008/0042948 | A1 | 2/2008 | Yamashita et al. |
| 2008/0043044 | A1 | 2/2008 | Woo et al. |
| 2008/0048951 | A1 | 2/2008 | Naugler et al. |
| 2008/0055134 | A1 | 3/2008 | Li et al. |
| 2008/0055209 | A1 | 3/2008 | Cok |
| 2008/0062106 | A1 | 3/2008 | Tseng |
| 2008/0074413 | A1 | 3/2008 | Ogura |
| 2008/0088549 | A1 | 4/2008 | Nathan et al. |
| 2008/0094426 | A1 | 4/2008 | Kimpe |
| 2008/0111766 | A1 | 5/2008 | Uchino et al. |
| 2008/0122803 | A1 | 5/2008 | Izadi et al. |
| 2008/0122819 | A1 | 5/2008 | Cho et al. |
| 2008/0074360 | A1 | 6/2008 | Lu et al. |
| 2008/0129906 | A1 | 6/2008 | Lin et al. |
| 2008/0198103 | A1 | 8/2008 | Toyomura et al. |
| 2008/0219232 | A1 | 9/2008 | Heubel et al. |
| 2008/0228562 | A1 | 9/2008 | Smith et al. |
| 2008/0230118 | A1 | 9/2008 | Nakatani et al. |
| 2008/0231625 | A1 | 9/2008 | Minami et al. |
| 2008/0231641 | A1 | 9/2008 | Miyashita |
| 2008/0265786 | A1 | 10/2008 | Koyama |
| 2008/0290805 | A1 | 11/2008 | Yamada et al. |
| 2009/0009459 | A1 | 1/2009 | Miyashita |
| 2009/0015532 | A1 | 1/2009 | Katayama et al. |
| 2009/0032807 | A1 | 2/2009 | Shinohara et al. |
| 2009/0051283 | A1 | 2/2009 | Cok et al. |
| 2009/0058789 | A1 | 3/2009 | Hung et al. |
| 2009/0121988 | A1 | 5/2009 | Amo et al. |
| 2009/0146926 | A1 | 6/2009 | Sung et al. |
| 2009/0153448 | A1 | 6/2009 | Tomida et al. |
| 2009/0153459 | A9 | 6/2009 | Han et al. |
| 2009/0160743 | A1 | 6/2009 | Tomida et al. |
| 2009/0162961 | A1 | 6/2009 | Deane |
| 2009/0174628 | A1 | 7/2009 | Wang et al. |
| 2009/0201230 | A1 | 8/2009 | Smith |
| 2009/0201281 | A1 | 8/2009 | Routley et al. |
| 2009/0206764 | A1 | 8/2009 | Schemmann et al. |
| 2009/0213046 | A1 | 8/2009 | Nam |
| 2009/0225011 | A1 | 9/2009 | Choi |
| 2009/0244046 | A1 | 10/2009 | Seto |
| 2009/0251486 | A1 | 10/2009 | Sakakibara et al. |
| 2009/0278777 | A1 | 11/2009 | Wang et al. |
| 2009/0289964 | A1 | 11/2009 | Miyachi |
| 2009/0295423 | A1 | 12/2009 | Levey |
| 2010/0026725 | A1 | 2/2010 | Smith |
| 2010/0033469 | A1 | 2/2010 | Nathan |
| 2010/0039451 | A1 | 2/2010 | Jung |
| 2010/0039453 | A1 | 2/2010 | Nathan et al. |
| 2010/0045646 | A1 | 2/2010 | Kishi |
| 2010/0052524 | A1 | 3/2010 | Kinoshita |
| 2010/0078230 | A1 | 4/2010 | Rosenblatt et al. |
| 2010/0079419 | A1 | 4/2010 | Shibusawa |
| 2010/0079711 | A1 | 4/2010 | Tanaka |
| 2010/0097335 | A1 | 4/2010 | Jung et al. |
| 2010/0133994 | A1 | 6/2010 | Song et al. |
| 2010/0134456 | A1 | 6/2010 | Oyamada |
| 2010/0134475 | A1 | 6/2010 | Ogura |
| 2010/0140600 | A1 | 6/2010 | Clough et al. |
| 2010/0141564 | A1 | 6/2010 | Choi et al. |
| 2010/0156279 | A1 | 6/2010 | Tamura et al. |
| 2010/0207920 | A1 | 8/2010 | Chaji et al. |
| 2010/0225634 | A1 | 9/2010 | Levey et al. |
| 2010/0237374 | A1 | 9/2010 | Chu et al. |
| 2010/0251295 | A1 | 9/2010 | Amento et al. |
| 2010/0269889 | A1 | 10/2010 | Reinhold et al. |
| 2010/0277400 | A1 | 11/2010 | Jeong |
| 2010/0315319 | A1 | 12/2010 | Cok et al. |
| 2010/0315449 | A1 | 12/2010 | Chaji |
| 2010/0328294 | A1 | 12/2010 | Sasaki et al. |
| 2011/0050741 | A1 | 3/2011 | Jeong |
| 2011/0063197 | A1 | 3/2011 | Chung et al. |
| 2011/0069089 | A1 | 3/2011 | Kopf et al. |
| 2011/0074762 | A1 | 3/2011 | Shirasaki |
| 2011/0084993 | A1 | 4/2011 | Kawabe |

(56) References Cited

U.S. PATENT DOCUMENTS

| | | | |
|---|---|---|---|
| 2011/0090210 | A1 | 4/2011 | Sasaki et al. |
| 2011/0109350 | A1 | 5/2011 | Chaji et al. |
| 2011/0133636 | A1 | 6/2011 | Matsuo et al. |
| 2011/0169805 | A1 | 7/2011 | Katsunori |
| 2011/0180825 | A1 | 7/2011 | Lee et al. |
| 2011/0191042 | A1 | 8/2011 | Chaji |
| 2011/0205221 | A1 | 8/2011 | Lin |
| 2012/0026146 | A1 | 2/2012 | Kim |
| 2012/0169793 | A1 | 7/2012 | Nathan |
| 2012/0212468 | A1 | 8/2012 | Govil |
| 2012/0299976 | A1 | 11/2012 | Chen et al. |
| 2012/0299978 | A1 | 11/2012 | Chaji |
| 2013/0009930 | A1 | 1/2013 | Cho et al. |
| 2013/0032831 | A1 | 2/2013 | Chaji et al. |
| 2013/0113785 | A1 | 5/2013 | Sumi |
| 2014/0267215 | A1 | 9/2014 | Soni |
| 2017/0025063 | A1* | 1/2017 | Chaji ..... G09G 3/3233 |

FOREIGN PATENT DOCUMENTS

| | | | |
|---|---|---|---|
| CA | 1 294 034 | | 1/1992 |
| CA | 2109951 | | 11/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 507 276 | | 8/2002 |
| CA | 2 483 645 | | 12/2003 |
| CA | 2 463 653 | | 1/2004 |
| CA | 2 498 136 | | 3/2004 |
| CA | 2498136 | | 3/2004 |
| CA | 2 522 396 | | 11/2004 |
| CA | 2522396 | | 11/2004 |
| CA | 2 438 363 | | 2/2005 |
| CA | 2 443 206 | | 3/2005 |
| CA | 2 519 097 | | 3/2005 |
| CA | 2443206 | | 3/2005 |
| CA | 2 472 671 | | 12/2005 |
| CA | 2472671 | | 12/2005 |
| CA | 2 523 841 | | 1/2006 |
| CA | 2 567 076 | | 1/2006 |
| CA | 2567076 | | 1/2006 |
| CA | 2526782 | | 4/2006 |
| CA | 2 495 726 | | 7/2006 |
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1381032 | | 11/2002 |
| CN | 1448908 | | 10/2003 |
| CN | 1601594 | A | 3/2005 |
| CN | 1776922 | | 5/2006 |
| CN | 1886774 | | 12/2006 |
| CN | 101395653 | | 3/2009 |
| DE | 20 2006 005427 | | 6/2006 |
| DE | 202006007613 | | 9/2006 |
| EP | 0 478 186 | | 4/1992 |
| EP | 0 940 796 | | 9/1999 |
| EP | 1 028 471 | A | 8/2000 |
| EP | 1 103 947 | | 5/2001 |
| EP | 1 130 565 | A1 | 9/2001 |
| EP | 1 184 833 | | 3/2002 |
| EP | 1 194 013 | | 4/2002 |
| EP | 1 310 939 | | 5/2003 |
| EP | 1 321 922 | | 6/2003 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 439 520 | | 7/2004 |
| EP | 1 465 143 | A | 10/2004 |
| EP | 1 467 408 | | 10/2004 |
| EP | 1 473 689 | A | 11/2004 |
| EP | 1 517 290 | | 3/2005 |
| EP | 1 517 290 | A2 | 3/2005 |
| EP | 1 521 203 | A2 | 4/2005 |
| EP | 2317499 | | 5/2011 |
| GB | 2 205 431 | | 12/1988 |
| GB | 2 399 935 | | 9/2004 |
| GB | 2 460 018 | | 11/2009 |
| JP | 09 090405 | | 4/1997 |
| JP | 10-153759 | | 6/1998 |
| JP | 10-254410 | | 9/1998 |
| JP | 11 231805 | | 8/1999 |
| JP | 11-282419 | | 10/1999 |
| JP | 2000/056847 | | 2/2000 |
| JP | 2000-077192 | | 3/2000 |
| JP | 2000-089198 | | 3/2000 |
| JP | 2000-352941 | | 12/2000 |
| JP | 2002-91376 | | 3/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-099000 | | 4/2003 |
| JP | 2003-150082 | | 5/2003 |
| JP | 2003-173165 | | 6/2003 |
| JP | 2003-177709 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-057217 | | 3/2005 |
| JP | 2005-099715 | | 4/2005 |
| JP | 2005-258326 | | 9/2005 |
| JP | 2005-338819 | | 12/2005 |
| JP | 2006065148 | | 3/2006 |
| JP | 2009282158 | | 12/2009 |
| TW | 485337 | | 5/2002 |
| TW | 502233 | | 9/2002 |
| TW | 538650 | | 6/2003 |
| TW | 569173 | | 1/2004 |
| TW | 200526065 | | 8/2005 |
| TW | 1239501 | | 9/2005 |
| WO | WO 94/25954 | | 11/1994 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 03/077231 | | 9/2003 |
| WO | WO 03/105117 | | 12/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/029455 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/053424 | | 5/2006 |
| WO | WO 2006/063448 | | 6/2006 |
| WO | WO 2006/128069 | | 11/2006 |
| WO | WO 2006/137337 | | 12/2006 |
| WO | WO 2007/003877 | A | 1/2007 |
| WO | WO 2007/079572 | | 7/2007 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |

(56) References Cited

FOREIGN PATENT DOCUMENTS

| | | |
|---|---|---|
| WO | WO 2010/023270 | 3/2010 |
| WO | WO 2010/066030 | 6/2010 |
| WO | WO 2010/120733 | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces"Keith Jack: "Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies ; Willem den Boer: "Active Matrix Liquid Crystal Display: Fundamentals and Applications" 2005 Referex ORD-000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18 2009 (12 pages).
European Search Report and Written Opinion for Application No. 08 86 5338 dated Nov. 2, 2011 (7 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Search Report for European Application No. EP 04 78 6661 dated Mar. 9, 2009.
European Search Report for European Application No. EP 05 75 9141 dated Oct. 30, 2009.
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Extended European Search Report Application No. EP 15173106.4 dated Oct. 15, 2013 (8 pages).
Extended European Search Report for Application No. EP 14181848. 4, dated Mar. 5, 2015, (9 pages).
Extended European Search Report dated Apr. 27, 2011 issued during prosecution of European patent application No. 09733076.5 (13 pages).

(56) References Cited

OTHER PUBLICATIONS

Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Search Report Application No. PCT/IB2013/059074, dated Dec. 18, 2013 (5 pages).
International Search Report for Application No. PCT/IB2014/059409, Canadian Intellectual Property Office, dated Jun. 12, 2014 (4 pages).
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
International Searching Authority Written Opinion Application No. PCT/IB2013/059074, dated Dec. 18, 2013 (8 pages ).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated Jun. 2006 (4 pages).
Nathan et al.: "Thin film imaging technology on glass and plastic" ICM 2000, Proceedings of the 12$^{th}$ International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan et al.: "Thin film imaging technology on glass and plastic"; dated Oct. 31-Nov. 2, 2000 (4 pages).
Office Action issued in Chinese Patent Application 200910246264.4 dated Jul. 5, 2013; 8 pages.
Ono et al. "Shared Pixel Compensation Circuit for AM-OLED Displays" Proceedings of the 9$^{th}$ Asian Symposium on Information Display (ASID) pp. 462-465 New Delhi dated Oct. 8-12, 2006 (4 pages).
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO LTD), Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Smith, Lindsay I., "A tutorial on Principal Components Analysis," dated Feb. 26, 2001 (27 pages).
Stewart M. et al., "Polysilicon TFT technology for active matrix OLED displays" IEEE transactions on electron devices, vol. 48, No. 5; Dated May 2001 (7 pages).
Tatsuya Sasaoka et al., 24.4L; Late-News Paper: A 13.0-inch AM-Oled Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated Feb. 2009.

(56) References Cited

OTHER PUBLICATIONS

Wang et al.: "Indium oxides by reactive ion beam assisted evaporation: From material study to device application"; dated Mar. 2009 (6 pages).
Written Opinion for Application No. PCT/IB2014/059409, Canadian Intellectual Property Office, dated Jun. 12, 2014 (5 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.

* cited by examiner

PIXELS AND REFERENCE CIRCUITS AND TIMING TECHNIQUES

PRIORITY CLAIM

This application is a continuation-in-part of U.S. patent application Ser. No. 15/215,036, filed Jul. 20, 2016, which claims priority to Canadian Application No. 2,898,282, filed Jul. 24, 2015, each of which is hereby incorporated by reference herein in its entirety.

FIELD OF THE INVENTION

The present disclosure relates to pixels, current biasing, and signal timing of light emissive visual display technology, and particularly to systems and methods for programming and calibrating pixels and pixel current biasing in active matrix light emitting diode device (AMOLED) and other emissive displays.

BRIEF SUMMARY

According to a first aspect there is provided a system for generating currents for pixels of an emissive display system, each pixel having a light-emitting device, the system comprising: a plurality of pixels; a plurality of current generating circuits for providing a current for at least one respective pixel; and a controller coupled to said current generating circuits for controlling said current generating circuits over a plurality of signal lines; wherein each current generating circuit comprises: at least one driving transistor for providing the current for the pixel; and a storage capacitance for being programmed and for setting a magnitude of the current provided by the at least one driving transistor; wherein the controller's controlling each current generating circuit comprises: during a programming cycle charging the storage capacitance to a defined level; and subsequent to the programming cycle, during a calibration cycle, partially discharging the storage capacitance as a function of characteristics of the at least one driving transistor.

In some embodiments, the at least one driving transistor comprises a driving transistor and the controller's controlling each current generating circuit further comprises: during the programming cycle charging the storage capacitance connected to a gate terminal of the driving transistor to include at least a threshold voltage of the driving transistor, such that during an emission cycle, a voltage across the source terminal and the drain terminal during the emission cycle is a function of the threshold voltage of the driving transistor.

In some embodiments, the at least one driving transistor comprises a driving transistor and the controller's controlling each current generating circuit further comprises: during the programming cycle charging the storage capacitance connected to a gate terminal of the driving transistor to include at least a first voltage applied to a source terminal of the driving transistor, such that during an emission cycle, during which a first voltage is maintained at the source terminal of the driving transistor, a voltage across the source terminal and the drain terminal is independent of the first voltage.

In some embodiments, the first voltage is one of VDD and VMON. In some embodiments, each current generating circuit comprises one of a reference current sink and a reference current source for providing the current for the at least one respective pixels, the current provided to provide reference current biasing for the at least one respective pixels. In some embodiments, each pixel comprises the current generating circuit for providing the current for said pixel, the current provided to drive the light-emitting device of said pixel. In some embodiments, the light emitting device is an Organic Light Emitting Diode (OLED).

In some embodiments, the controller's controlling each current generating circuit further comprises: during a reset cycle commencing substantially simultaneously with an emission cycle, resetting to a low reference voltage at least one of an anode of the OLED and a terminal of the at least one driving transistor.

According to a second aspect there is provided a method for generating currents for pixels of an emissive display system, each pixel having a light-emitting device, the system comprising a plurality of pixels, a plurality of current generating circuits for providing a current for at least one respective pixel, each current generating circuit comprising at least one driving transistor for providing the current for the pixel, and a storage capacitance for being programmed and for setting a magnitude of the current provided by the at least one driving transistor, the method comprising: controlling each current generating circuit over a plurality of lines comprising: charging the storage capacitance to a defined level during a programming cycle; and subsequent to the programming cycle, during a calibration cycle, partially discharging the storage capacitance as a function of characteristics of the at least one driving transistor.

In some embodiments, the at least one driving transistor comprises a driving transistor and controlling each current generating circuit further comprises: during the programming cycle, charging the storage capacitance connected to a gate terminal of the driving transistor to include at least a threshold voltage of the driving transistor, such that during an emission cycle a voltage across the source terminal and the drain terminal is a function of the threshold voltage of the driving transistor.

In some embodiments, the at least one driving transistor comprises a driving transistor and controlling each current generating circuit further comprises: during the programming cycle charging the storage capacitance connected to a gate terminal of the driving transistor to include at least a first voltage applied to a source terminal of the driving transistor, such that during an emission cycle, during which a first voltage is maintained at the source terminal of the driving transistor, a voltage across the source terminal and the drain terminal is independent of the first voltage.

In some embodiments, the controlling each current generating circuit further comprises: during a reset cycle commencing substantially simultaneously with an emission cycle, resetting to a low reference voltage at least one of an anode of the OLED and a terminal of the at least one driving transistor.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
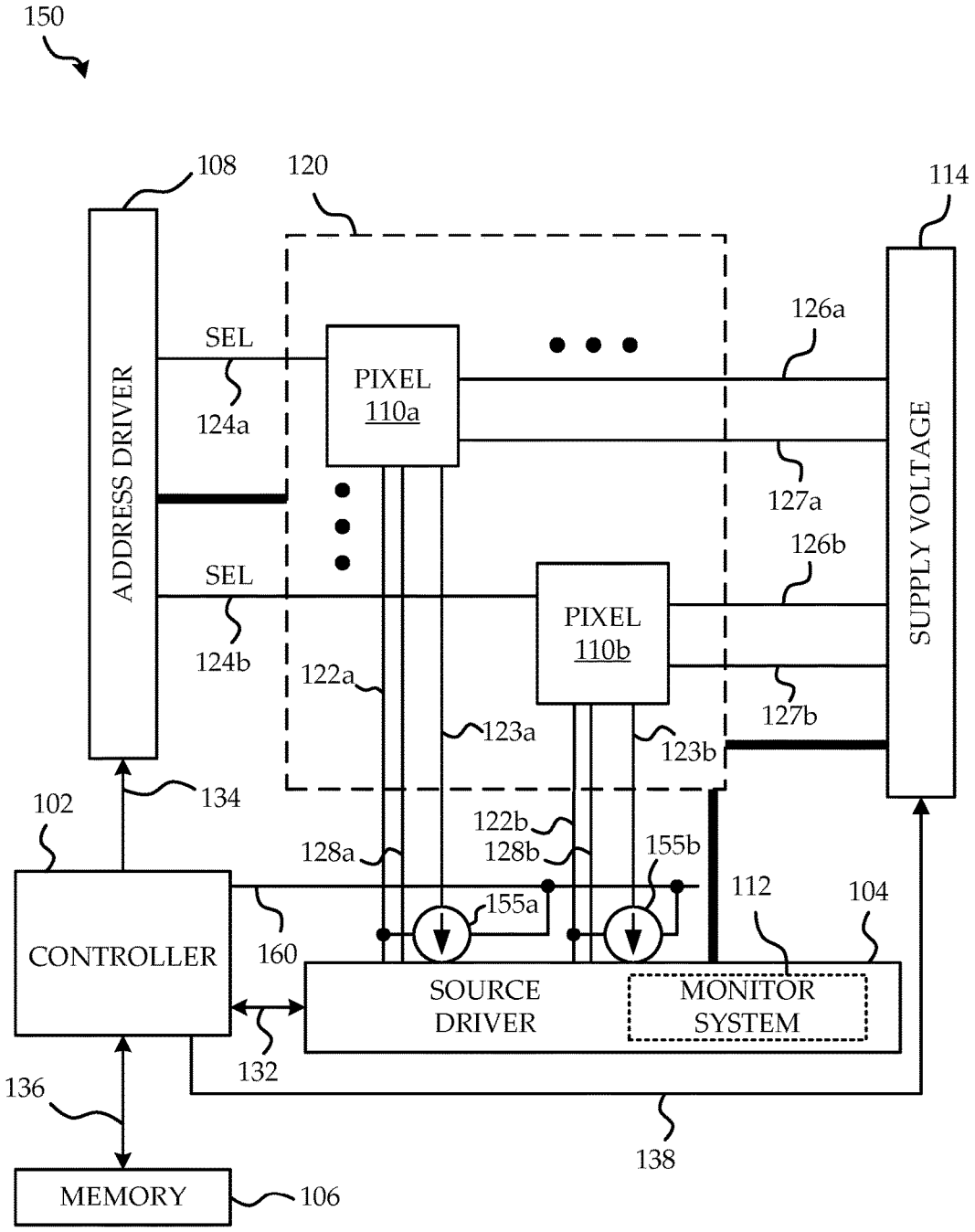
FIG. 1 illustrates an example display system utilizing the methods and comprising the pixels and current biasing elements disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduce the image represented by the image data. Some displays utilize a current-bias voltage-programming driving scheme, each of its pixels being a current-biased voltage-programmed (CBVP) pixel. In such displays a further requirement for producing and maintaining accurate image reproduction is that the current biasing elements, that is the current sources or sinks, which provide current biasing provide the appropriate level of current biasing to those pixels.

Due to unavoidable variations in fabrication and variations in degradation through use, a number of current biasing elements provided for a display and pixels of the display, although designed to be uniformly and exactly alike and programmed to provide the desired current biasing level and respectively desired luminance, in fact exhibit deviations in current biasing and respectively luminance provided. In order to correct for visual defects that would otherwise arise from the non-uniformity and inaccuracies of these current sources or sinks and the pixels, the programming of the current biasing elements and pixels are augmented with calibration and optionally monitoring and compensation.

As the resolution of an array semiconductor device increases, the number of lines and elements required to drive, calibrate, and/or monitor the array increases dramatically. This can result in higher power consumption, higher manufacturing costs, and a larger physical foot print. In the case of a CBVP pixel display, providing circuitry to program, calibrate, and monitor current sources or sinks can increase cost and complexity of integration as the number of rows or columns increases.

The systems and methods disclosed below address these issues through control timing and calibration of pixel circuits and a family of current biasing elements while utilizing circuits which are integrated on the display in a manner which use existing display components.

While the embodiments described herein will be in the context of AMOLED displays it should be understood that the systems and methods described herein are applicable to any other display comprising pixels which might utilize current biasing, including but not limited to light emitting diode displays (LED), electroluminescent displays (ELD), organic light emitting diode displays (OLED), plasma display panels (PSP), among other displays.

It should be understood that the embodiments described herein pertain to systems and methods of calibration and compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods and comprising the circuits described further below. The display system 150 includes a display panel 120, an address driver 108, a source driver 104, a controller 102, and a memory storage 106.

The display panel 120 includes an array of pixels 110*a* 110*b* (only two explicitly shown) arranged in rows and columns. Each of the pixels 110*a* 110*b* is individually programmable to emit light with individually programmable luminance values and is a current biased voltage programmed pixel (CBVP). The controller 102 receives digital data indicative of information to be displayed on the display panel 120. The controller 102 sends signals 132 to the source driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 incorporates features from current biasing elements 155*a*, 155*b*, either current sources or sinks (current sinks are shown) to provide biasing currents to the pixels 110*a* 110*b* in the display panel 120 to thereby decrease programming time for the pixels 110. Although shown separately from the source driver 104, current biasing elements 155*a*, 155*b* may form part of the source driver 104 or may be integrated as separate elements. It is to be understood that the current biasing elements 155*a*, 155*b* used to provide current biasing to the pixels may be current sources rather than current sinks depicted in FIG. 1.

For illustrative purposes, only two pixels 110*a*, 110*b* are explicitly shown in the display system 150 in FIG. 1. It is understood that the display system 150 is implemented with a display screen that includes an array of pixels, such as the pixels 110*a*, 110*b*, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

Each pixel 110*a*, 110*b* is operated by a driving circuit or pixel circuit that generally includes a driving transistor and a light emitting device. Hereinafter the pixel 110*a*, 110*b* may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110*a*, 110*b* can optionally be an n-type or p-type amorphous silicon thin-film transistor, but implementations of the present disclosure are not limited to pixel circuits having a particular polarity of transistor or only to pixel circuits having thin-film transistors. The pixel circuit 110*a*, 110*b* can also include a storage capacitor for storing programming information and allowing the pixel circuit 110 to drive the light emitting device after being addressed. Thus, the display panel 120 can be an active matrix display array.

As illustrated in FIG. 1, each of the pixels 110*a*, 110*b* in the display panel 120 are coupled to a respective select line 124*a*, 124*b*, a respective supply line 126*a*, 126*b*, a respective data line 122*a*, 122*b*, a respective current bias line 123*a*, 123*b*, and a respective monitor line 128*a*, 128*b*. A read line may also be included for controlling connections to the monitor line. In one implementation, the supply voltage 114 can also provide a second supply line to each pixel 110*a*, 110*b*. For example, each pixel can be coupled to a first supply line 126*a*, 126*b* charged with Vdd and a second supply line 127*a*, 127*b* coupled with Vss, and the pixel circuits 110*a*, 110*b* can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections, and pixels sharing various connections.

With reference to the pixel 110*a* of the display panel 120, the select line 124*a* is provided by the address driver 108, and can be utilized to enable, for example, a programming operation of the pixel 110*a* by activating a switch or transistor to allow the data line 122*a* to program the pixel 110*a*. The data line 122*a* conveys programming information from the source driver 104 to the pixel 110*a*. For example, the data line 122*a* can be utilized to apply a programming voltage or a programming current to the pixel 110*a* in order to program the pixel 110*a* to emit a desired amount of luminance. The programming voltage (or programming current) supplied by the source driver 104 via the data line 122*a* is a voltage (or current) appropriate to cause the pixel 110*a* to emit light with a desired amount of luminance according to the digital data received by the controller 102. The programming voltage (or programming current) can be applied to the pixel 110*a* during a programming operation of the pixel 110*a* so as to charge a storage device within the pixel 110*a*, such as a storage capacitor, thereby enabling the pixel 110*a* to emit light with the desired amount of luminance during an emission operation following the programming operation. For example, the storage device in the pixel 110*a* can be charged during a programming operation to apply a voltage to one or more of a gate or a source terminal of the driving transistor during the emission operation, thereby causing the driving transistor to convey the driving current through the light emitting device according to the voltage stored on the storage device. Current biasing element 155*a* provides a biasing current to the pixel 110*a* over the current bias line 123*a* in the display panel 120 to thereby decrease programming time for the pixel 110*a*. The current biasing element 155*a* is also coupled to the data line 122*a* and uses the data line 122*a* to program its current output when not in use to program the pixels, as described hereinbelow. In some embodiments, the current biasing elements 155*a*, 155*b* are also coupled to a reference/monitor line 160 which is coupled to the controller 102, for monitoring and controlling of the current biasing elements 155*a*, 155*b*.

Generally, in the pixel 110*a*, the driving current that is conveyed through the light emitting device by the driving transistor during the emission operation of the pixel 110*a* is a current that is supplied by the first supply line 126*a* and is drained to a second supply line 127*a*. The first supply line 126*a* and the second supply line 127*a* are coupled to the voltage supply 114. The first supply line 126*a* can provide a positive supply voltage (e.g., the voltage commonly referred to in circuit design as "Vdd") and the second supply line 127*a* can provide a negative supply voltage (e.g., the voltage commonly referred to in circuit design as "Vss"). Implementations of the present disclosure can be realized where one or the other of the supply lines (e.g., the supply line 127*a*) is fixed at a ground voltage or at another reference voltage.

The display system 150 also includes a monitoring system 112. With reference again to the pixel 110*a* of the display panel 120, the monitor line 128*a* connects the pixel 110*a* to the monitoring system 112. The monitoring system 112 can be integrated with the source driver 104, or can be a separate stand-alone system. In particular, the monitoring system 112 can optionally be implemented by monitoring the current and/or voltage of the data line 122*a* during a monitoring operation of the pixel 110*a*, and the monitor line 128*a* can be entirely omitted. The monitor line 128*a* allows the monitoring system 112 to measure a current or voltage associated with the pixel 110*a* and thereby extract information indicative of a degradation or aging of the pixel 110*a* or indicative of a temperature of the pixel 110*a*. In some embodiments, display panel 120 includes temperature sensing circuitry devoted to sensing temperature implemented in the pixels 110*a*, while in other embodiments, the pixels 110*a* comprise circuitry which participates in both sensing temperature and driving the pixels. For example, the monitoring system 112 can extract, via the monitor line 128*a*, a current flowing through the driving transistor within the pixel 110*a* and thereby determine, based on the measured current and based on the voltages applied to the driving transistor during the measurement, a threshold voltage of the driving transistor or a shift thereof. In some embodiments the monitoring system 112 extracts information regarding the current biasing elements via data lines 122*a*, 122*b* or the reference/monitor line 160 and in some embodiments this is performed in cooperation with or by the controller 102.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110*a*, the aging information is retrieved from the memory 106 by the controller 102 via memory signals 136, and the controller 102 then compensates for the extracted degradation information in subsequent programming and/or emission operations of the pixel 110*a*. For example, once the degradation information is extracted, the programming information conveyed to the pixel 110*a* via the data line 122*a* can be appropriately adjusted during a subsequent programming operation of the pixel 110*a* such that the pixel 110*a* emits light with a desired amount of luminance that is independent of the degradation of the pixel 110*a*. In an example, an increase in the threshold voltage of the driving transistor within the pixel 110*a* can be compensated for by appropriately increasing the programming voltage applied to the pixel 110*a*. In a similar manner, the monitoring system 112 can extract the bias current of a current biasing element 155*a*. The monitoring system 112 can then communicate signals 132 to the controller 102 and/or the memory 106 to allow the display system 150 to store the extracted information in the memory 106. During subsequent programming of the current biasing element 155*a*, the information is retrieved from the memory 106 by the controller 102 via memory signals 136, and the controller 102 then compensates for the errors in current previously measured using adjustments in subsequent programming of the current biasing element 155*a*.

Figure 2:
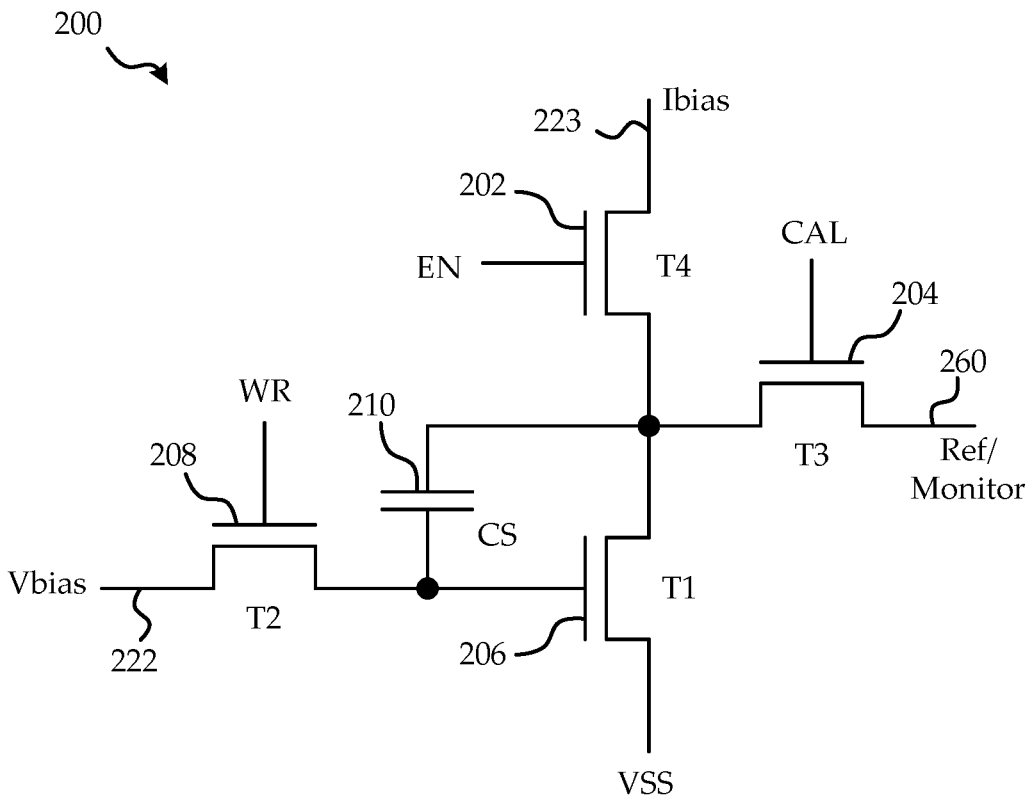
FIG. 2 is a circuit diagram of a current sink according to one embodiment.

Referring to FIG. 2, the structure of a current sink 200 circuit according to an embodiment will now be described. The current sink 200 corresponds, for example, to a single current biasing element 155*a*, 155*b* of the display system 150 depicted in FIG. 1 which provides a bias current Ibias over current bias lines 123*a*, 123*b* to a CBVP pixel 110*a*, 110*b*. The current sink 200 depicted in FIG. 2 is based on PMOS transistors. A PMOS based current source is also contemplated, structured and functioning according to similar principles described here. It should be understood that variations of this current sink and its functioning are contemplated and include different types of transistors (PMOS, NMOS, or CMOS) and different semiconductor materials (e.g., LTPS, Metal Oxide, etc.).

The current sink 200 includes a first switch transistor 202 (T4) controlled by an enable signal EN coupled to its gate terminal, and being coupled via one of a source and drain terminal to a current bias line 223 (Ibias) corresponding to, for example, a current bias line 123*a* of FIG. 1, and coupled via the other of the source and drain terminals of the first switch transistor 202 to a first terminal of a storage capacitance 210. A gate terminal of a current drive transistor 206 (T1) is coupled to a second terminal of the storage capacitance 210, while one of the source and gate terminals of the current drive transistor 206 is coupled to the first terminal of the storage capacitance 210. The other of the source and gate terminals of the current drive transistor 206 is coupled to VSS. A gate terminal of a second switch transistor 208 (T2) is coupled to a write signal line (WR), while one of its source and drain terminals is coupled to a voltage bias or data line (Vbias) 222, corresponding, for example, to data line 122*a* depicted in FIG. 1. The other of the source and drain terminals of the second switch transistor 208 is coupled to the second terminal of the storage capacitance 210. A gate terminal of a third switch transistor 204 (T3) is coupled to a calibration control line (CAL), while one of its source and drain terminals is coupled to a reference monitor line 260, corresponding, for example, to reference monitor line 160 depicted in FIG. 1. The other of the source and drain terminals of the third switch transistor 204 is coupled to the first terminal of the storage capacitance 210. As mentioned above the data lines are shared, being used for providing voltage biasing or data for the pixels during certain time periods during a frame and being used for providing voltage biasing for the current biasing element, here a current sink, during other time periods of a frame. This re-use of the data lines allows for the added benefits of programming and compensation of the numerous individual current sinks using only one extra reference monitoring line 160.

Figure 3:
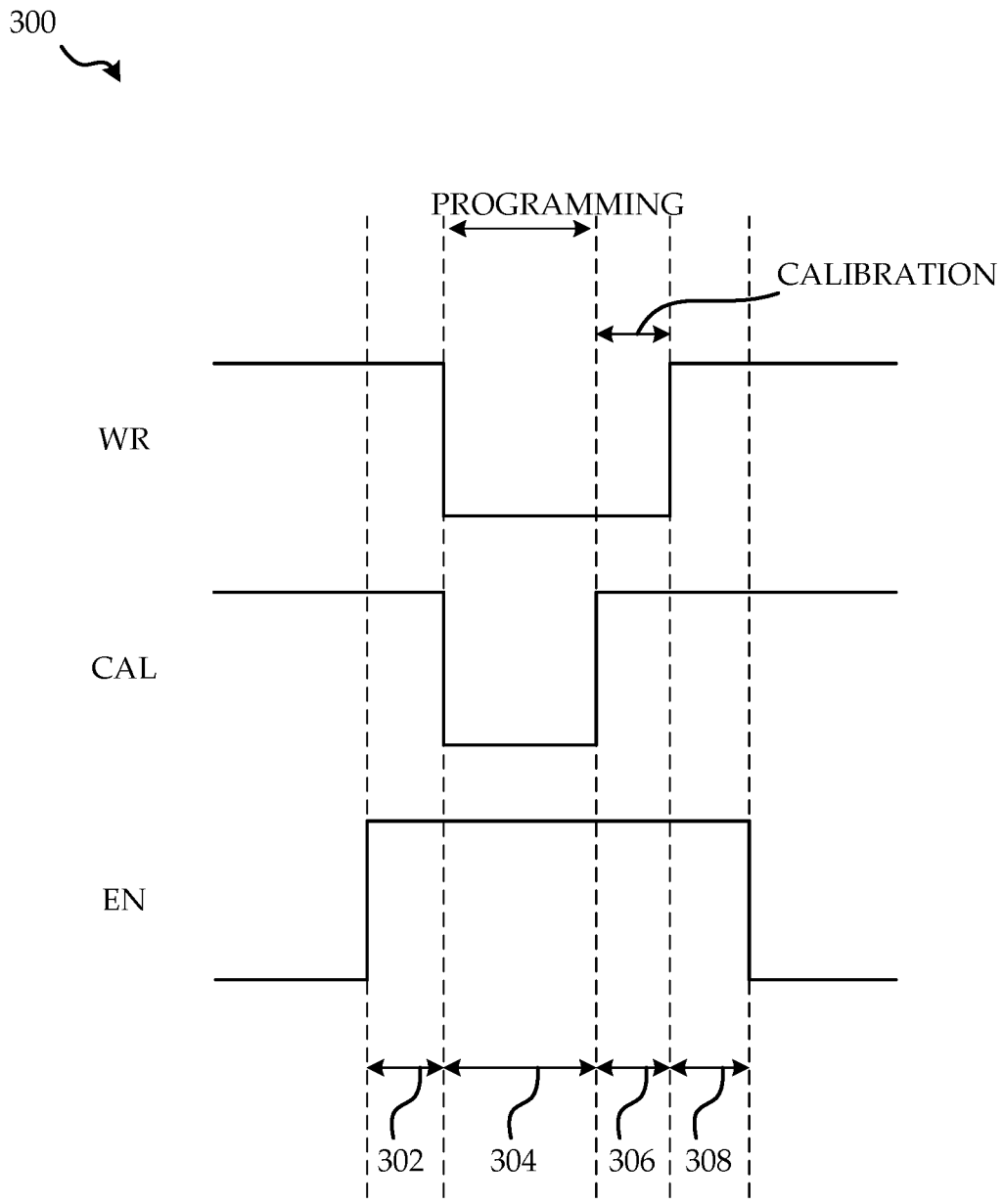
FIG. 3 is a timing diagram of current sink and source programming and calibration according to one embodiment.

With reference also to FIG. 3, an example of a timing of a current control cycle 300 for programming and calibrating the current sink 200 depicted in FIG. 2 will now be described. The complete control cycle 300 occurs typically once per frame and includes four smaller cycles, a disconnect cycle 302, a programming cycle 304, a calibration cycle 306, and a settling cycle 308. During the disconnect cycle 302, the current sink 200 ceases to provide biasing current Ibias to the current bias line 223 in response to the EN signal going high and the first transistor switch 202 turning off. By virtue of the CAL and WR signals being high, both the second and third switch transistors 208, 204 remain off. The duration of the disconnect cycle 302 also provides a settling time for the current sink 200 circuit. The EN signal remains high throughout the entire control cycle 300, only going low once the current sink 200 circuit has been programmed, calibrated, and settled and is ready to provide the bias current over the current bias line 223. Once the current sink 200 has settled after the disconnect cycle 302 has completed, the programming cycle 304 begins with the WR signal going low turning on the second switch transistor 208 and with the CAL signal going low turning on the third switch transistor 204. During the programming cycle 304 therefore, the third switch transistor 204 connects the reference monitor line 260 over which there is transmitted a known reference signal (can be voltage or current) to the first terminal of the storage capacitance 210, while the second switch transistor 208 connects the voltage bias or data line 222 being input with voltage Vbias to the gate terminal of the current driving transistor 206 and the second terminal of the storage capacitance 210. As a result, the storage capacitance 210 is charged to a defined value. This value is roughly that which is anticipated as necessary to control the current driving transistor 206 to deliver the appropriate current biasing Ibias taking into account optional calibration described below.

After the programming cycle 304 and during the calibration cycle 306, the circuit is reconfigured to discharge some of the voltage (charge) of the storage capacitance 210 though the current driving transistor 206. The calibration signal CAL goes high, turning off the third switch transistor 204 and disconnecting the first terminal of the storage capacitance 210 from the reference monitor line 260. The amount discharged is a function of the main element of the current sink 200, namely the current driving transistor 206 or its related components. For example, if the current driving transistor 206 is "strong", the discharge occurs relatively quickly and relatively more charge is discharged from the storage capacitance 210 through the current driving transistor 206 during the fixed duration of the calibration cycle 306. On the other hand, if the current driving transistor 206 is "weak", the discharge occurs relatively slowly and relatively less charge is discharged from the storage capacitance 210 through the current driving transistor 206 during the fixed duration of the calibration cycle 306. As a result the voltage (charge) stored in the storage capacitance 210 is reduced comparatively more for relatively strong current driving transistors versus comparatively less for relatively weak current driving transistors thereby providing some compensation for non-uniformity and variations in current driving transistors across the display whether due to variations in fabrication or variations in degradation over time.

After the calibration cycle 306, a settling cycle 308 is performed prior to provision of the biasing current Ibias to the current bias line 223. During the settling cycle 308, the first and third switch transistors 202, 204 remain off while the WR signal goes high to also turn the second switch transistor 208 off. After completion of the duration of the settling cycle 308, the enable signal EN goes low turning on the first switch transistor 202 and allowing the current driving transistor 206 to sink the Ibias current on the current bias line 223 according to the voltage (charge) stored in the storage capacitance 210, which as mentioned above, has a value which has been drained as a function of the current driving transistor 206 in order to provide compensation for the specific characteristics of the current driving transistor 206.

In some embodiments, the calibration cycle 306 is eliminated. In such a case, the compensation manifested as a change in the voltage (charge) stored by the storage capacitance 210 as a function of the characteristics of the current driving transistor 206 is not automatically provided. In such a case a form of manual compensation may be utilized in combination with monitoring.

In some embodiments, after a current sink 200 has been programmed, and prior to providing the biasing current over the current bias line 223, the current of the current sink 200 is measured through the reference monitor line 260 by controlling the CAL signal to go low, turning on the third switch transistor 204. As illustrated in FIG. 1, in some embodiments the reference monitor line 160 is shared and hence during measurement of the current sink 200 of interest all other current sinks are programmed or otherwise controlled such that they do not source or sink any current on the reference monitor line 160. Once the current of the current sink 200 has been measured in response to known programming of the current sink 200 and possibly after a number of various current measurements in response to various programming values have been measured and stored in memory 106, the controller 102 and memory 106 (possibly in cooperation with other components of the display system 150) adjusts the voltage Vbias used to program the current sink 200 to compensate for the deviations from the expected or desired current sinking exhibited by the current sink 200. This monitoring and compensation, need not be performed every frame and can be performed in a periodic manner over the lifetime of the display to correct for degradation of the current sink 200.

In some embodiments a combination of calibration and monitoring and compensation is used. In such a case the calibration can occur every frame in combination with periodic monitoring and compensation.

Figure 4:
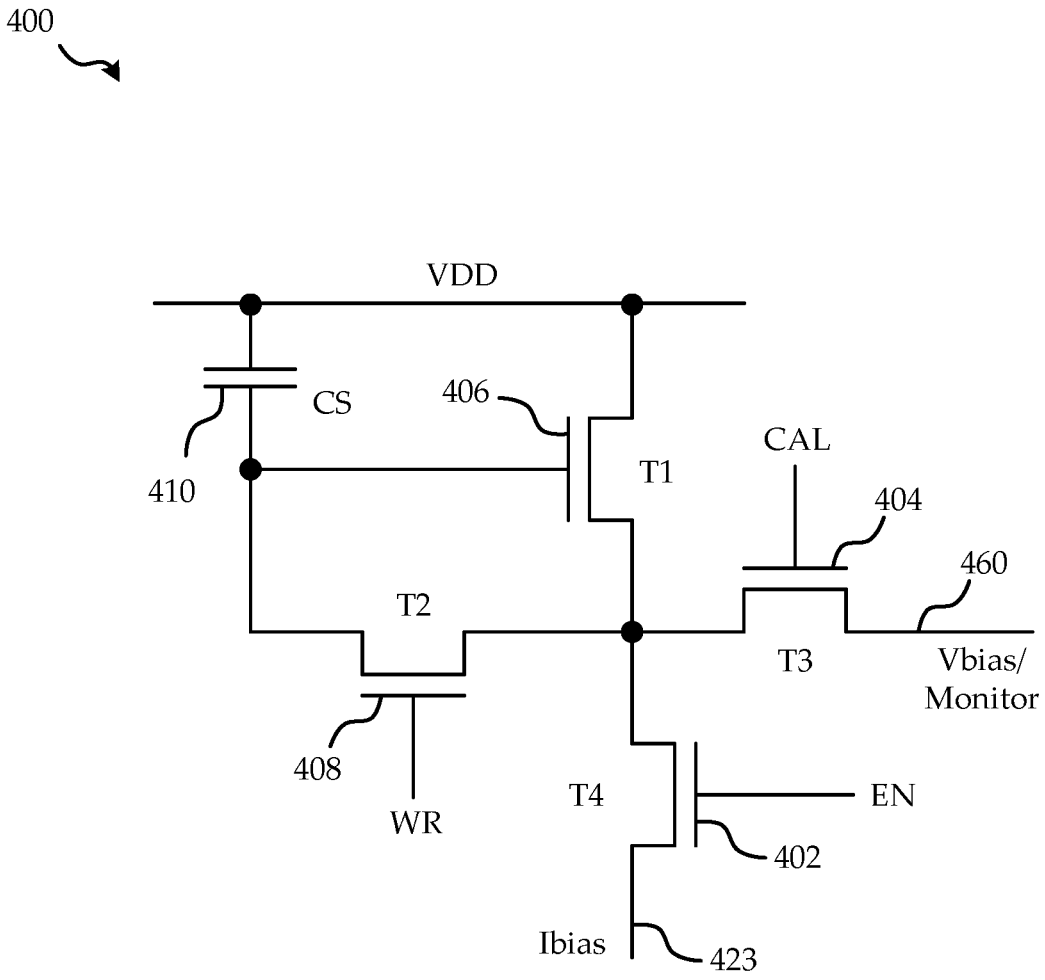
FIG. 4 is a circuit diagram of a current source according to a further embodiment.

Referring to FIG. 4, the structure of a current source 400 circuit according to an embodiment will now be described. The current source 400 corresponds, for example, to a single current biasing element 155*a*, 155*b* of the display system 150 depicted in FIG. 1 which provides a bias current Ibias over current bias lines 123*a*, 123*b* to a CBVP pixel 110*a*, 110*b*. As is described in more detail below, the connections and manner of integration of current source 400 into the display system 150 is slightly different from that depicted in FIG. 1 for a current sink 200. The current source 400 depicted in FIG. 4 is based on PMOS transistors. It should be understood that variations of this current source and its functioning are contemplated and include different types of transistors (PMOS, NMOS, or CMOS) and different semiconductor materials (e.g., LTPS, Metal Oxide, etc.).

The current source 400 includes a first switch transistor 402 (T4) controlled by an enable signal EN coupled to its gate terminal, and being coupled via one of a source and drain terminal of the first transistor switch 405 to a current bias line 423 (Ibias) corresponding to, for example, a current bias line 123*a* of FIG. 1. A gate terminal of a current drive transistor 406 (T1) is coupled to a first terminal of a storage capacitance 410, while a first of the source and drain terminals of the current drive transistor 406 is coupled to the other of the source and drain terminals of the first switch transistor 402, and a second of the source and drain terminals of the current drive transistor 406 is coupled to a second terminal of the storage capacitance 410. The second terminal of the storage capacitance 410 is coupled to VDD. A gate terminal of a second switch transistor 408 (T2) is coupled to a write signal line (WR), while one of its source and drain terminals is coupled to the first terminal of the storage capacitance 410 and the other of its source and drain terminals is coupled to the first of the source and drain terminals of the current driving transistor 406. A gate terminal of a third switch transistor 404 (T3) is coupled to a calibration control line (CAL), while one of its source and drain terminals is coupled to a voltage bias monitor line 460, corresponding, for example, to voltage bias or data lines 122*a*, 122*b* depicted in FIG. 1. The other of the source and drain terminals of the third switch transistor 404 is coupled to the first of the source and drain terminals of the current drive transistor 406.

In the embodiment depicted in FIG. 4, the current source is not coupled to a reference monitor line 160 such as that depicted in FIG. 1. Instead of the current source 400 being programmed with Vbias and a reference voltage as in the case of the current sink 200, the storage capacitance 410 of the current source 400 is programmed to a defined value using the voltage bias signal Vbias provided over the voltage bias or data line 122*a* and VDD. In this embodiment the data lines 122*a*, 122*b* serve as monitor lines as and when needed.

Referring once again to FIG. 3, an example of a timing of a current control cycle 300 for programming and calibrating the current source 400 depicted in FIG. 4 will now be described. The timing of the current control cycle 300 for programming the current source 400 of FIG. 4 is the same as that for the current sink 200 of FIG. 2.

The complete control cycle 300 occurs typically once per frame and includes four smaller cycles, a disconnect cycle 302, a programming cycle 304, a calibration cycle 306, and a settling cycle 308. During the disconnect cycle 302, the current source 400 ceases to provide biasing current Ibias to the current bias line 423 in response to the EN signal going high and the first transistor switch 402 turning off. By virtue of the CAL and WR signals being high, both the second and third switch transistors 408, 404 remain off. The duration of the disconnect cycle 402 also provides a settling time for the current source 400 circuit. The EN signal remains high throughout the entire control cycle 300, only going low once the current source 400 circuit has been programmed, calibrated, and settled and is ready to provide the bias current over the current bias line 423. Once the current source 400 has settled after the disconnect cycle 302 has completed, the programming cycle 304 begins with the WR signal going low turning on the second switch transistor 408 and with the CAL signal going low turning on the third switch transistor 404. During the programming cycle 304 therefore, the third switch transistor 404 and the second switch transistor 408 connects the voltage bias monitor line 460 over which there is transmitted a known Vbias signal to the first terminal of the storage capacitance 410. As a result, since the second terminal of the storage capacitance 410 is coupled top VDD, the storage capacitance 410 is charged to a defined value. This value is roughly that which is anticipated as necessary to control the current driving transistor 406 to deliver the appropriate current biasing Ibias taking into account optional calibration described below.

After the programming cycle 304 and during the calibration cycle 306, the circuit is reconfigured to discharge some of the voltage (charge) of the storage capacitance 410 though the current driving transistor 406. The calibration signal CAL goes high, turning off the third switch transistor 404 and disconnecting the first terminal of the storage capacitance 410 from the voltage bias monitor line 460. The amount discharged is a function of the main element of the current source 400, namely the current driving transistor 406 or its related components. For example, if the current driving transistor 406 is "strong", the discharge occurs relatively quickly and relatively more charge is discharged from the storage capacitance 410 through the current driving transistor 406 during the fixed duration of the calibration cycle 306. On the other hand, if the current driving transistor 406 is "weak," the discharge occurs relatively slowly and relatively less charge is discharged from the storage capacitance 410 through the current driving transistor 406 during the fixed duration of the calibration cycle 306. As a result the voltage (charge) stored in the storage capacitance 410 is reduced comparatively more for relatively strong current driving transistors versus comparatively less for relatively weak current driving transistors thereby providing some compensation for non-uniformity and variations in current driving transistors across the display whether due to variations in fabrication or degradation over time.

After the calibration cycle 306, a settling cycle 308 is performed prior to provision of the biasing current Ibias to the current bias line 423. During the settling cycle, the first and third switch transistors 402, 404 remain off while the WR signal goes high to also turn the second switch transistor 408 off. After completion of the duration of the settling cycle 308, the enable signal EN goes low turning on the first switch transistor 402 and allowing the current driving transistor 406 to source the Ibias current on the current bias line 423 according to the voltage (charge) stored in the storage capacitance 410, which as mentioned above, has a value which has been drained as a function of the current driving transistor 406 in order to provide compensation for the specific characteristics of the current driving transistor 406.

In some embodiments, the calibration cycle 306 is eliminated. In such a case, the compensation manifested as a change in the voltage (charge) stored by the storage capacitance 410 as a function of the characteristics of the current driving transistor 406 is not automatically provided. In such a case, as with the embodiment above in the context of a current sink 200 a form of manual compensation may be utilized in combination with monitoring for the current source 400.

In some embodiments, after a current source 400 has been programmed, and prior to providing the biasing current over the current bias line 423, the current of the current source 400 is measured through the voltage bias monitor line 460 by controlling the CAL signal to go low, turning on the third switch transistor 404.

Once the current of the current source 400 has been measured in response to known programming of the current source 400 and possibly after a number of various current measurements in response to various programming values have been measured and stored in memory 106, the controller 102 and memory 106 (possibly in cooperation with other components of the display system 150) adjusts the voltage Vbias used to program the current source 400 to compensate for the deviations from the expected or desired current sourcing exhibited by the current source 400. This monitoring and compensation, need not be performed every frame and can be performed in a periodic manner over the lifetime of the display to correct for degradation of the current source 400.

Although the current sink 200 of FIG. 2 and the current source 400 of FIG. 4 have each been depicted as possessing a single current driving transistor 206, 406 it should be understood that each may comprise a cascaded transistor structure for providing the same functionality as shown and described in association with FIG. 2 and FIG. 4.

Figure 5:
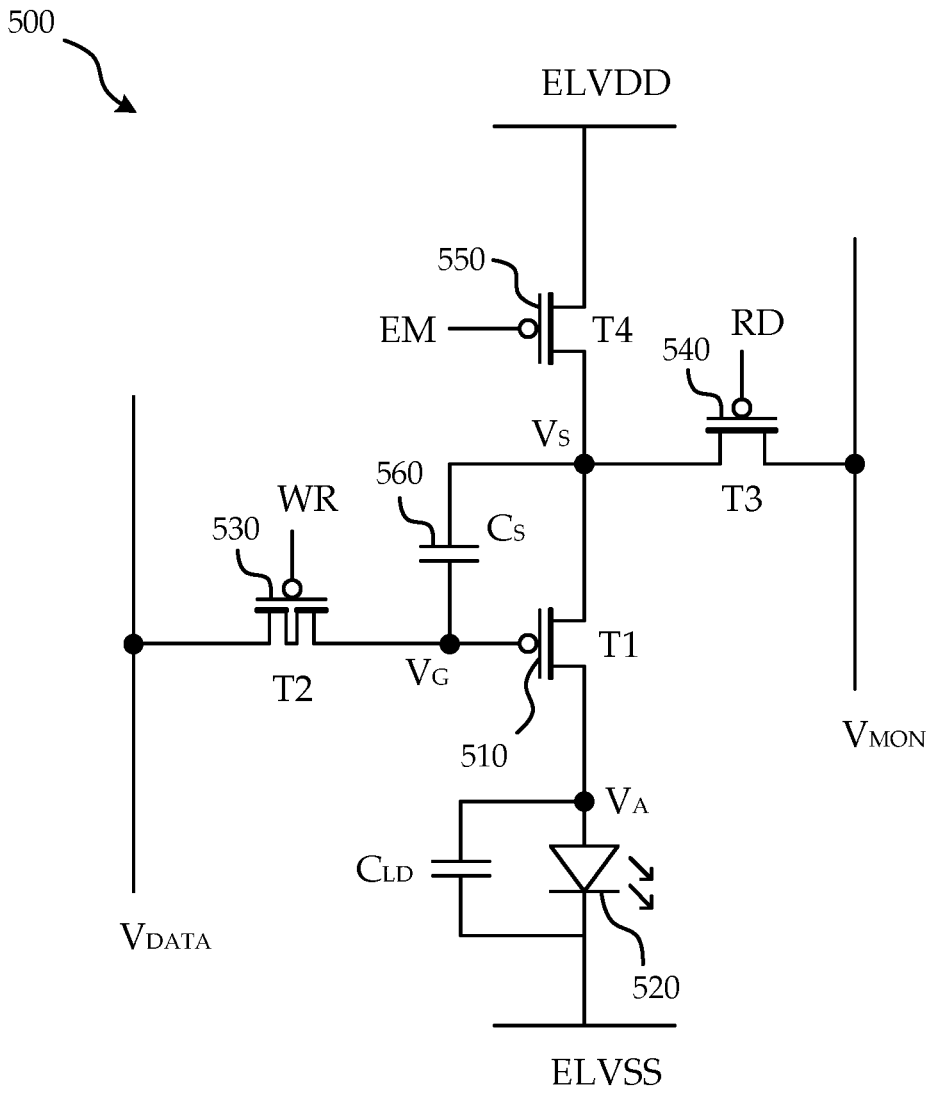
FIG. 5 is a circuit diagram of a 4T1C pixel circuit according to an embodiment.

With reference to FIG. 5, the structure of a four transistor, single capacitor (4T1C) pixel circuit 500 according to an embodiment will now be described. The 4T1C pixel circuit 500 corresponds, for example, to a single pixel 110*a* of the display system 150 depicted in FIG. 1 which in some embodiments is not necessarily a current biased pixel. The 4T1C pixel circuit 500 depicted in FIG. 5 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The 4T1C pixel circuit 500 includes a driving transistor 510 (T1), a light emitting device 520, a first switch transistor 530 (T2), a second switch transistor 540 (T3), a third switch transistor 550 (T4), and a storage capacitor 560 ($C_S$). Each of the driving transistor 510, the first switch transistor 530, the second switch transistor 540, and the third switch transistor 550 having first, second, and gate terminals, and each of the light emitting device 520 and the storage capacitor 560 having first and second terminals.

The gate terminal of the driving transistor 510 is coupled to a first terminal of the storage capacitor 560, while the first terminal of the driving transistor 510 is coupled to the second terminal of the storage capacitor 560, and the second terminal of the driving transistor 510 is coupled to the first terminal of the light emitting device 520. The second terminal of the light emitting device 520 is coupled to a first reference potential ELVSS. A capacitance of the light-emitting device 520 is depicted in FIG. 5 as $C_{LD}$ In some embodiments, the light emitting device 520 is an OLED. The gate terminal of the first switch transistor 530 is coupled to a write signal line (WR), while the first terminal of the first switch transistor 530 is coupled to a data signal line ($V_{DATA}$), and the second terminal of the first switch transistor 530 is coupled to the gate terminal of the driving transistor 510. A node common to the gate terminal of the driving transistor 510 and the storage capacitor 560 as well as the first switch transistor 530 is labelled by its voltage $V_G$ in the figure. The gate terminal of the second switch transistor 540 is coupled to a read signal line (RD), while the first terminal of the second switch transistor 540 is coupled to a monitor signal line ($V_{MON}$), and the second terminal of the second switch transistor 540 is coupled to the second terminal of the storage capacitor 560. The gate terminal of the third switch transistor 550 is coupled to an emission signal line (EM), while the first terminal of the third switch transistor 550 is coupled to a second reference potential ELVDD, and the second terminal of the third switch transistor 550 is coupled to the second terminal of the storage capacitor 560. A node common to the second terminal of the storage capacitor 560, the driving transistor 510, the second switch transistor 540, and the third switch transistor 550 is labelled by its voltage $V_S$ in the figure.

Figure 6A:
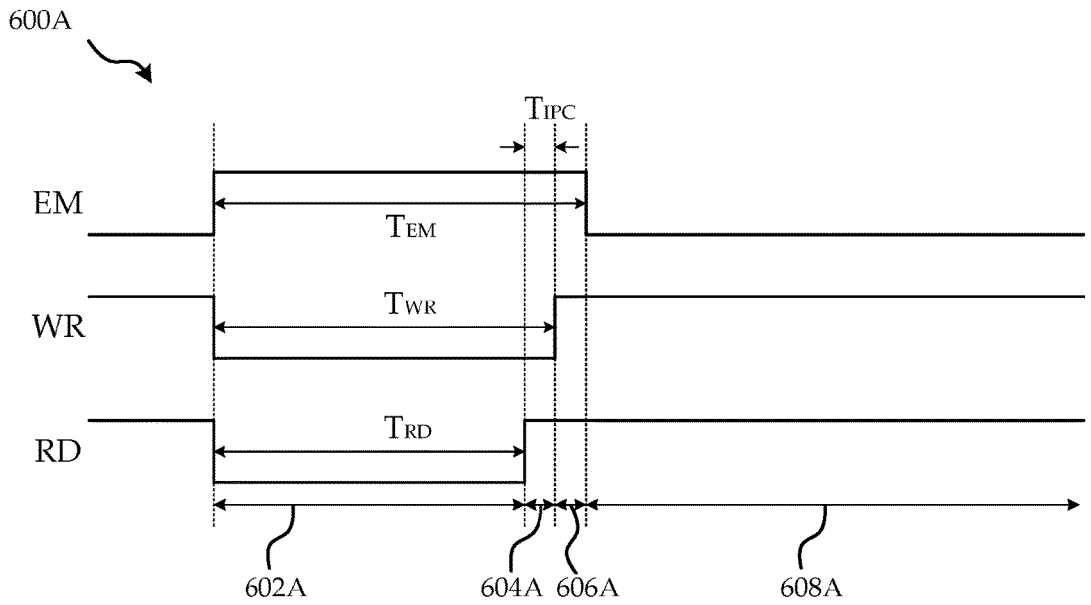
FIG. 6A is a timing diagram illustrating a programming and driving of a 4T1C pixel circuit.

With reference also to FIG. 6A, an example of a display timing 600A for the 4T1C pixel circuit 500 depicted in FIG. 5 will now be described. The complete display timing 600A occurs typically once per frame and includes a programming cycle 602A, a calibration cycle 604A, a settling cycle 606A, and an emission cycle 608A. During the programming cycle 602A over a period $T_{RD}$, the read signal (RD) and write signal (WR) are held low while the emission (EM) signal is held high. The emission signal (EM) is held high throughout the programming, calibration, and settling cycles 602A 604A 606A to ensure the third switch transistor 550 remains off during those cycles ($T_{EM}$).

During the programming cycle 602A the first switch transistor 530 and the second switch transistor 540 are both on. The voltage of the storage capacitor 560 and therefore the voltage $V_{SG}$ of the driving transistor 510 is charged to a value of $V_{MON}-V_{DATA}$ where $V_{MON}$ is a voltage of the monitor line and $V_{DATA}$ is a voltage of the data line. These voltages are set in accordance with a desired programming voltage for causing the pixel 500 to emit light at a desired luminance according to image data.

At the beginning of the calibration cycle 604A, the read line (RD) goes high to turn off the second switch transistor 540 to discharge some of the voltage (charge) of the storage capacitor 560 through the driving transistor 510. The amount discharged is a function of the characteristics of the driving transistor 510. For example, if the driving transistor 510 is "strong", the discharge occurs relatively quickly and relatively more charge is discharged from the storage capacitor 560 through the driving transistor 510 during the fixed duration $T_{IPC}$ of the calibration cycle 604A. On the other hand, if the driving transistor 510 is "weak", the discharge occurs relatively slowly and relatively less charge is discharged from the storage capacitor 560 through the driving transistor 510 during the calibration cycle 604A. As a result, the voltage (charge) stored in the storage capacitor 560 is reduced comparatively more for relatively strong driving transistors versus comparatively less for relatively weak driving transistors, thereby providing some compensation for non-uniformity and variations in the driving transistors across the display whether due to variations in fabrication or variations in degradation over time.

After the calibration cycle 604A, a settling cycle 606A is performed prior to the emission. During the settling cycle 606A the second and third switch transistors 540, 550 remain off, while the write signal (WR) goes high to also turn off the first switch transistor 530. After completion of the duration of the settling cycle 606A at the start of the emission cycle 608A, the emission signal (EM) goes low turning on the third switch transistor 550 allowing current to flow through the light emitting device 520 according to the calibrated stored voltage on the storage capacitor 560.

Figure 6B:
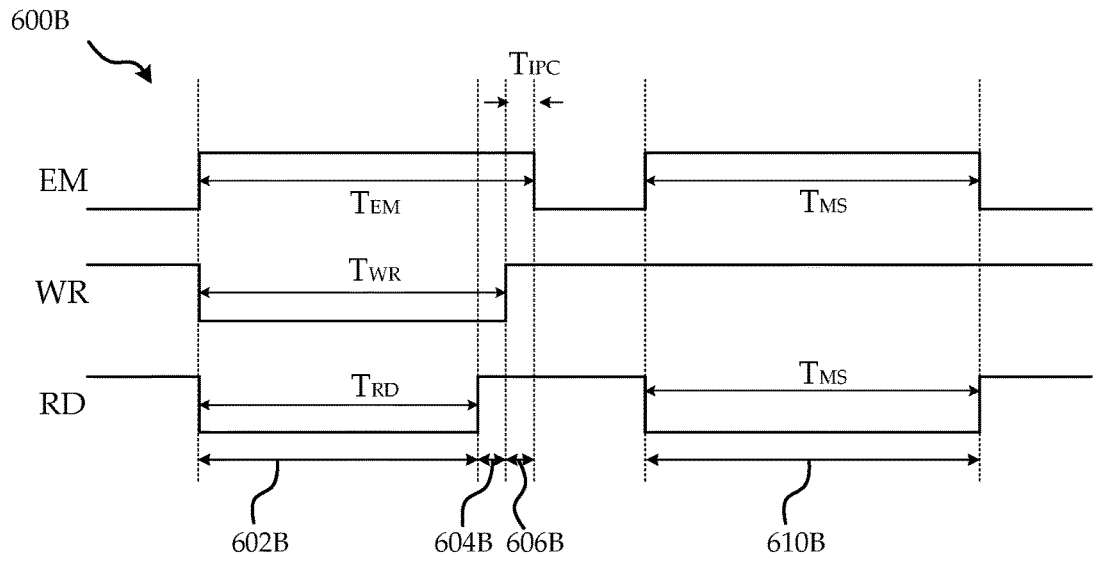
FIG. 6B is a timing diagram illustrating a programming and measuring of a 4T1C pixel circuit.

With reference also to FIG. 6B, an example of a measurement timing 600B for the 4T1C pixel circuit 500 depicted in FIG. 5 will now be described. The complete measurement timing 600B occurs typically in the same time period as a display frame and includes a programming cycle 602B, a calibration cycle 604B, a settling cycle 606B, and a measurement cycle 610B. The programming cycle 602B, calibration cycle 604B, settling cycle 606B, are performed substantially the same as described above in connection with FIG. 6A, however, a number of the voltages set for $V_{DATA}$, $V_{MON}$, and stored on the storage capacitor 560 are determined with the goal of measuring the pixel circuit 500 instead of displaying any particular luminance according to image data.

Once the programming cycle 602B, calibration cycle 604B, and settling cycle 606B are completed, a measuring cycle 610B having duration $T_{MS}$ commences. At the beginning of the measuring cycle 610B, the emission signal (EM) goes high turning off the third switch transistor 550, while the read signal (RD) goes low turning on the second switch transistor 540 to provide read access to the monitor line.

For measurement of the driving transistor 510, the programming voltage $V_{SG}$ for the driving transistor 510 is set to the desired level through the programming 602B, and calibration 604B cycles, and then during the duration $T_{MS}$ of the measurement cycle 610B the current/charge is observed on the monitor line $V_{MON}$. The voltage $V_{MON}$ on the monitor line is kept at a high enough level in order to operate the driving transistor 510 in saturation mode for measurement of the driving transistor 510.

For measurement of the light emitting device 520, the programming voltage $V_{SG}$ for the driving transistor 510 is set to the highest possible voltage available on the data line $V_{DATA}$, for example a value corresponding to peak-white gray-scale, through the programming 602B, and calibration 604B cycles, in order to operate the driving transistor 510 in the triode region (switch mode). In this condition, during the duration $T_{MS}$ of the measurement cycle 610B the voltage/current of the light emitting device 520 can be directly modulated/measured through the monitor line.

Figure 7:
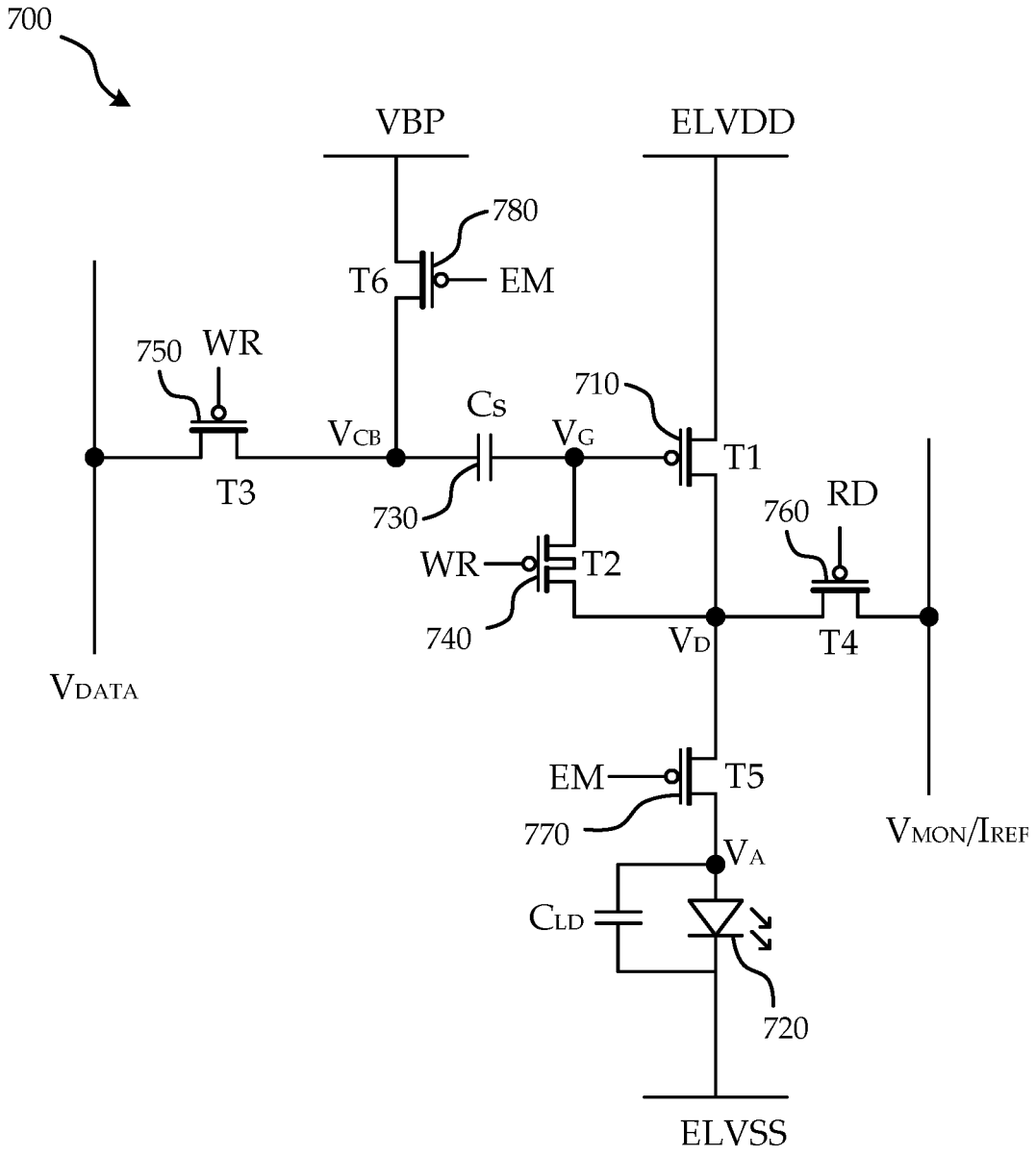
FIG. 7 is a circuit diagram of a 6T1C pixel circuit according to an embodiment.

With reference to FIG. 7, the structure of a six transistor, single capacitor (6T1C) pixel circuit 700 according to an embodiment will now be described. The 6T1C pixel circuit 700 corresponds, for example, to a single pixel 110*a* of the display system 150 depicted in FIG. 1 which in some embodiments is not necessarily a current biased pixel. The 6T1C pixel circuit 700 depicted in FIG. 7 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The 6T1C pixel circuit 700 includes a driving transistor 710 (T1), a light emitting device 720, a storage capacitor 730

($C_S$), a first switch transistor 740 (T2), a second switch transistor 750 (T3), a third switch transistor 760 (T4), a fourth switch transistor 770 (T5), and a fifth switch transistor 780 (T6). Each of the driving transistor 710, the first switch transistor 740, the second switch transistor 750, the third switch transistor 760, the fourth switch transistor 770, and the fifth switch transistor 780, having first, second, and gate terminals, and each of the light emitting device 720 and the storage capacitor 730 having first and second terminals.

The gate terminal of the driving transistor 710 is coupled to a first terminal of the storage capacitor 730, while the first terminal of the driving transistor 710 is coupled to a first reference potential ELVDD, and the second terminal of the driving transistor 710 is coupled to the first terminal of the third switch transistor 760. The gate terminal of the third switch transistor 760 is coupled to a read signal line (RD) and the second terminal of the third switch transistor 760 is coupled to a monitor/reference current line $V_{MON}/I_{REF}$. The gate terminal of the fourth switch transistor 770 is coupled to an emission signal line (EM), while the first terminal of the fourth switch transistor 770 is coupled to the first terminal of the third switch transistor 760, and the second terminal of the fourth switch transistor 770 is coupled to the first terminal of the light emitting device 720. A second terminal of the light emitting device 720 is coupled to a second reference potential ELVSS. A capacitance of the light-emitting device 720 is depicted in FIG. 7 as $C_{LD}$. In some embodiments, the light emitting device 720 is an OLED. The gate terminal of the first switch transistor 740 is coupled to a write signal line (WR), while the first terminal of the first switch transistor 740 is coupled to the first terminal of the storage capacitor 730, and the second terminal of the first switch transistor 740 is coupled to the first terminal of the third switch transistor 760. The gate terminal of the second switch transistor 750 is coupled to the write signal line (WR), while the first terminal of the second switch transistor 750 is coupled to a data signal line ($V_{DATA}$), and the second terminal of the second switch transistor 750 is coupled to the second terminal of the storage capacitor 730. A node common to the gate terminal of the driving transistor 710 and the storage capacitor 730 as well as the first switch transistor 740 is labelled by its voltage $V_G$ in the figure. The gate terminal of the fifth switch transistor 780 is coupled to the emission signal line (EM), while the first terminal of the fifth switch transistor 780 is coupled to reference potential VBP, and the second terminal of the fifth switch transistor 780 is coupled to the second terminal of the storage capacitor 730. A node common to the second terminal of the storage capacitor 730, the second switch transistor 750, and the fifth switch transistor 780 is labelled by its voltage $V_{CB}$ in FIG. 7.

Figure 8A:
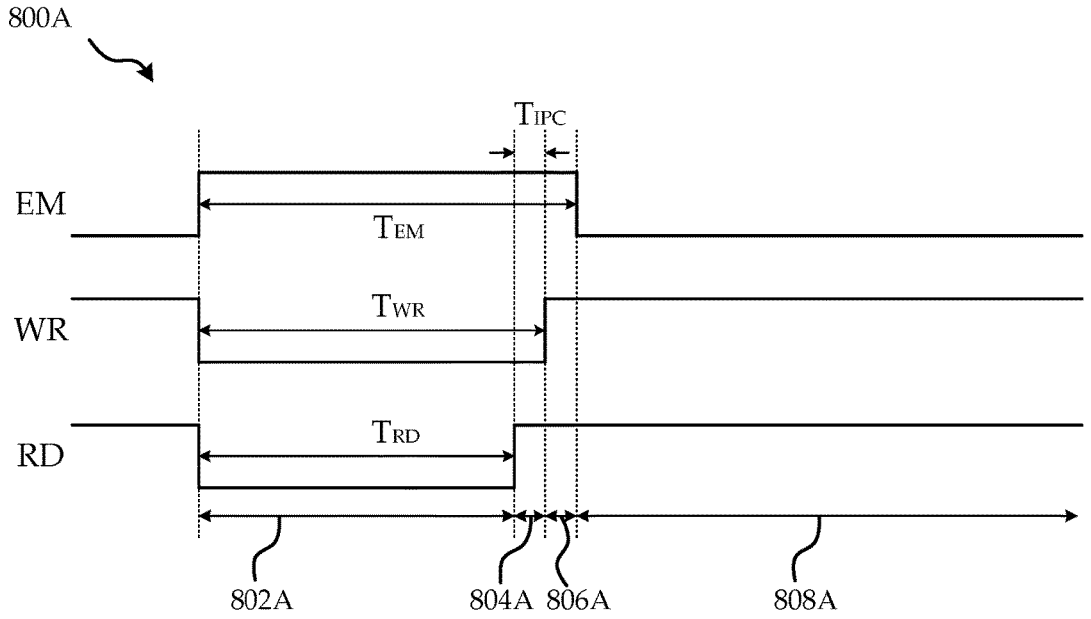
FIG. 8A is a timing diagram illustrating a programming and driving of a 6T1C pixel circuit.

With reference also to FIG. 8A, an example of a display timing 800A for the 6T1C pixel circuit 700 depicted in FIG. 7 will now be described. The complete display timing 800A occurs typically once per frame and includes a programming cycle 802A, a calibration cycle 804A, a settling cycle 806A, and an emission cycle 808A. During the programming cycle 802A over a period $T_{RD}$, the read signal (RD) and write signal (WR) are held low while the emission (EM) signal is held high. The emission signal (EM) is held high throughout the programming, calibration, and settling cycles 802A 804A 806A to ensure the fourth switch transistor 770 and the fifth switch transistor 780 remain off during those cycles ($T_{EM}$).

During the programming cycle 802A the first switch transistor 740, the second switch transistor 750, and the third switch transistor 760 are all on. The voltage of the storage capacitor 730 $V_{CS}$ is charged to a value of $V_{CB}-V_G=V_{DATA}-(V_{DD}-V_{SG}(T1))\approx V_{DATA}-V_{DATA}-V_{DD}+V_{th}(T1)$, where $V_{DATA}$ is a voltage on the data line, $V_{DD}$ is the voltage of the first reference potential (also referred to as ELVDD), $V_{SG}$ (T1) the voltage across the gate terminal and the first terminal of the driving transistor 710, and $V_{th}$(T1) is a threshold voltage of the driving transistor 710. Here $V_{DATA}$ is set taking into account a desired programming voltage for causing the pixel 700 to emit light at a desired luminance according to image data.

At the beginning of the calibration cycle 804A, the read line (RD) goes high to turn off the third switch transistor 760 to discharge some of the voltage (charge) of the storage capacitor 730 through the driving transistor 710. The amount discharged is a function of the characteristics of the driving transistor 710. For example, if the driving transistor 710 is "strong", the discharge occurs relatively quickly and relatively more charge is discharged from the storage capacitor 730 through the driving transistor 710 during the fixed duration $T_{IPC}$ of the calibration cycle 804A. On the other hand, if the driving transistor 710 is "weak," the discharge occurs relatively slowly and relatively less charge is discharged from the storage capacitor 730 through the driving transistor 710 during the calibration cycle 804A. As a result, the voltage (charge) stored in the storage capacitor 730 is reduced comparatively more for relatively strong driving transistors versus comparatively less for relatively weak driving transistors, thereby providing some compensation for non-uniformity and variations in the driving transistors across the display whether due to variations in fabrication or variations in degradation over time.

After the calibration cycle 804A, a settling cycle 806A is performed prior to the emission cycle 808A. During the settling cycle 806A the third, fourth, and fifth switch transistors 760, 770, and 780 remain off, while the write signal (WR) goes high to also turn off the first and second switch transistors 740, 750. After completion of the duration of the settling cycle 806A at the start of the emission cycle 808A, the emission signal (EM) goes low turning on the fourth and fifth switch transistors 770, 780. This causes the driving transistor 710 to be driven with a voltage $V_{SG}=V_{DD}-V_G=V_{DD}-(VBP-V_{CS})=V_{DD}-VBP+V_{DATA}-V_{DD}+V_{th}(T1)=V_{DATA}+V_{th}(T1)-VBP$. This allows current to flow through the light emitting device 720 according to the calibrated stored voltage on the storage capacitor 730, and which is also a function of the threshold voltage $V_{th}$(T1) of the driving transistor 710 and which is independent of $V_{DD}$.

Figure 8B:
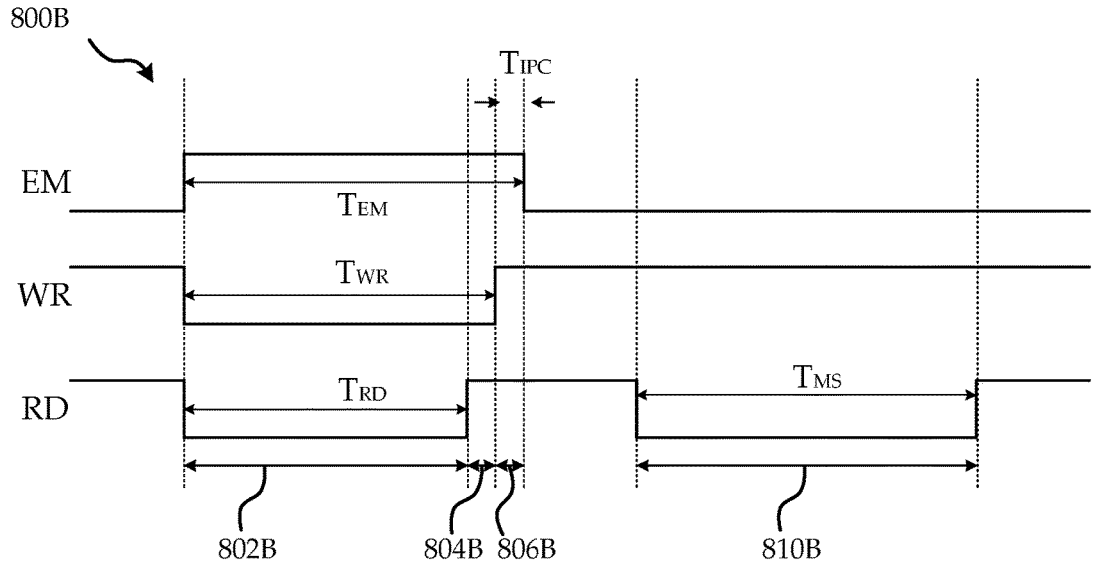
FIG. 8B is a timing diagram illustrating a programming and measuring of a 6T1C pixel circuit.

With reference also to FIG. 8B, an example of a measurement timing 800B for the 6T1C pixel circuit 700 depicted in FIG. 7 will now be described. The complete measurement timing 800B occurs typically in the same time period as a display frame and includes a programming cycle 802B, a calibration cycle 804B, a settling cycle 806B, and a measurement cycle 810B. The programming cycle 802B, calibration cycle 804B, settling cycle 806B, are performed substantially the same as described above in connection with FIG. 8A, however, a number of voltages set for $V_{DATA}$, $V_{MON}$, VBP, and stored on the storage capacitor 730 are determined with the goal of measuring the pixel circuit 700 instead of displaying any particular luminance according to image data.

Once the programming cycle 802B, calibration cycle 804B, and settling cycle 806B are completed, a measuring cycle 810B having duration $T_{MS}$ commences. At the beginning of the measuring cycle 810B, the read signal (RD) goes low turning on the third switch transistor 760 to provide read access to the monitor line. The emission signal (EM) is kept low, and hence the fourth and fifth switch transistors 770, 780 are kept on during the entire duration $T_{MS}$ of the measurement.

For measurement of the driving transistor 710, the programming voltage $V_{SG}$ for the driving transistor 710 is set to the desired level through the programming 802B, and calibration 804B, settling 806B, and emission 808B cycles, and then during the duration $T_{MS}$ of the measurement cycle 810B the current/charge is observed on the monitor line $V_{MON}$. The voltage of the second reference potential (ELVSS) is raised to a high enough level (for example to ELVDD) in order to avoid interference from the light emitting device 720.

For measurement of the light emitting device 720, the programming voltage $V_{SG}$ for the driving transistor 710 is set to the lowest possible voltage available on the data line $V_{DATA}$, for example a value corresponding to black-level gray-scale, through the programming 802B, calibration 804B, settling 806B and emission 808B cycles, in order to avoid interfering with the current of the light emitting device 720.

Figure 9:
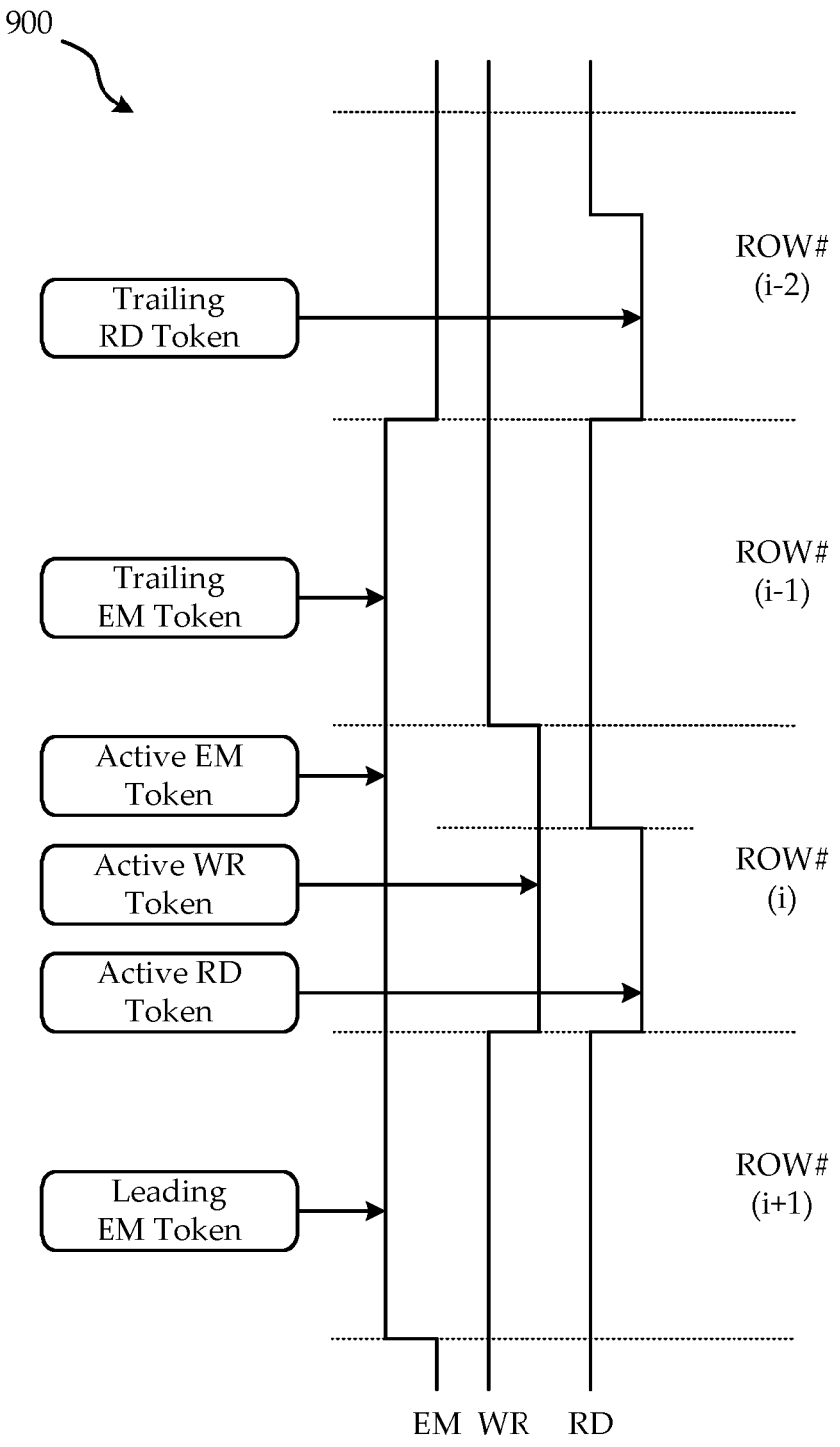
FIG. 9 is a timing diagram for improved driving of rows of pixels.

With reference to FIG. 9, a diagram for improved timing 900 for driving rows of pixels, such as the 4T1C and 6T1C pixels described herein, similar to the timing cycles illustrated herein, will now be described.

For illustrative purposes the improved timing 900 is shown in relation to its application to four consecutive rows, Row #(i−2), Row #(i−1), Row #(i), and Row #(i+1). The high emission signal EM spans three rows, Row #(i+1), Row #(i), Row #(i−1), the leading EM token spanning row Row #(i+1) is followed by the active EM token spanning Row #(i) which is followed by the trailing EM token spanning Row #(i−1). These are used to ensure steady-state condition for all pixels on a row during the active programming time of Row #(i). The start of an active RD token on Row #(i) trails the leading EM token but is in line with an Active WR token, and corresponds to the simultaneous going low of the RD and WR signals at the start of the programming cycle described in association with other timing diagrams herein. The Active RD token ends prior to the end of the Active WR token for Row #(i), which corresponds to the calibration cycle allowing for partial discharge of the storage capacitor through the driving transistor. A trailing RD token Row #(i−2) is asserted with a gap after the active RD token (and once EN is low and the pixel is just beginning to emit light) in order to reset the anode of the light-emitting device (OLED) and drain of the driving transistor to a low reference voltage available on the monitor line. This further "reset cycle" via the monitor line is particularly useful in embodiments such as the 6T1C pixels 700, 1100 of FIG. 7 and FIG. 11.

Figure 10:
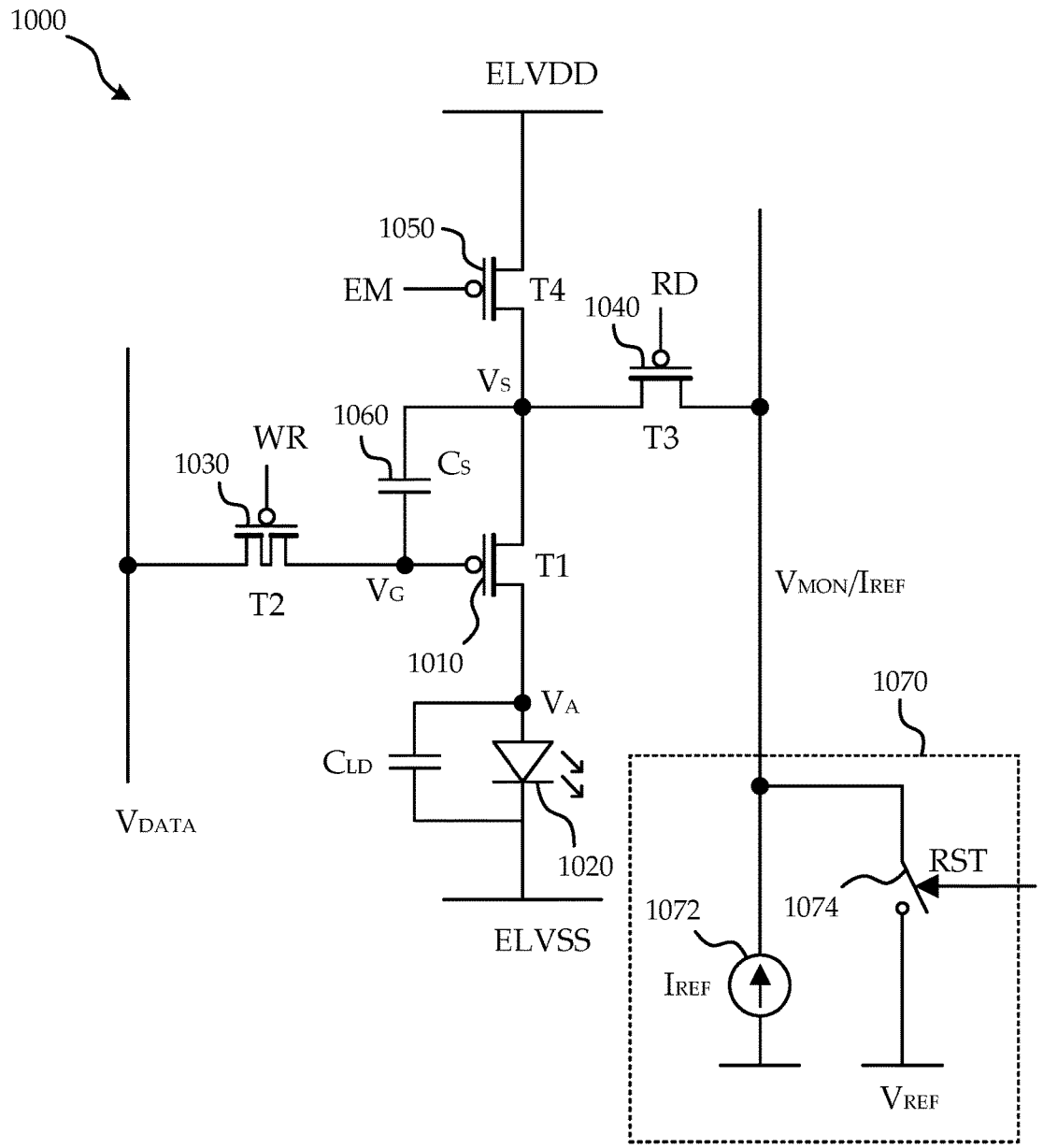
FIG. 10 is a circuit diagram of a 4T1C pixel circuit operated in current mode according to an embodiment.

With reference to FIG. 10, the structure of a four transistor, single capacitor (4T1C) pixel circuit 1000 operated in current mode according to an embodiment will now be described. The 4T1C pixel circuit 1000 corresponds, for example, to a single pixel 110*a* of the display system 150 depicted in FIG. 1. The embodiment depicted in FIG. 10 is a current biased pixel. An associated biasing circuit 1070 for biasing the 4T1C pixel circuit 1000 is illustrated. The biasing circuit 1070 is coupled to the 4T1C pixel circuit 1000 via the monitoring/current bias line ($V_{MON}/I_{REF}$). The 4T1C pixel circuit 1000 depicted in FIG. 10 is based on NMOS transistors. It should be understood that variations of this pixel and its functioning are contemplated and include different types of transistors (PMOS, NMOS, or CMOS) and different semiconductor materials (e.g., LTPS, Metal Oxide, etc.).

The 4T1C pixel circuit 1000 is structured substantially the same as the 4T1C pixel circuit 500 illustrated in FIG. 5. The 4T1C pixel circuit 1000 includes a driving transistor 1010 (T1), a light emitting device 1020, a first switch transistor 1030 (T2), a second switch transistor 1040 (T3), a third switch transistor 1050 (T4), and a storage capacitor 1060 ($C_S$). Each of the driving transistor 1010, the first switch transistor 1030, the second switch transistor 1040, and the third switch transistor 1050 having first, second, and gate terminals, and each of the light emitting device 1020 and the storage capacitor 1060 having first and second terminals.

The gate terminal of the driving transistor 1010 is coupled to a first terminal of the storage capacitor 1060, while the first terminal of the driving transistor 1010 is coupled to the second terminal of the storage capacitor 1060, and the second terminal of the driving transistor 1010 is coupled to the first terminal of the light emitting device 1020. The second terminal of the light emitting device 1020 is coupled to a first reference potential ELVSS. A capacitance of the light-emitting device 1020 is depicted in FIG. 10 as $C_{LD}$. In some embodiments, the light emitting device 1020 is an OLED. The gate terminal of the first switch transistor 1030 is coupled to a write signal line (WR), while the first terminal of the first switch transistor 1030 is coupled to a data signal line ($V_{DATA}$), and the second terminal of the first switch transistor 1030 is coupled to the gate terminal of the driving transistor 1010. A node common to the gate terminal of the driving transistor 1010 and the storage capacitor 1060 as well as the first switch transistor 1030 is labelled by its voltage $V_G$ in the figure. The gate terminal of the second switch transistor 1040 is coupled to a read signal line (RD), while the first terminal of the second switch transistor 1040 is coupled to a monitor/reference current line ($V_{MON}/I_{REF}$), and the second terminal of the second switch transistor 1040 is coupled to the second terminal of the storage capacitor 1060. The gate terminal of the third switch transistor 1050 is coupled to an emission signal line (EM), while the first terminal of the third switch transistor 1050 is coupled to a second reference potential ELVDD, and the second terminal of the third switch transistor 1050 is coupled to the second terminal of the storage capacitor 1060. A node common to the second terminal of the storage capacitor 1060, the driving transistor 1010, the second switch transistor 1040, and the third switch transistor 1050 is labelled by its voltage $V_S$ in the figure.

Coupled to the monitor/reference current line is a biasing circuit 1070, including a current source 1072 providing reference current $I_{RF}$ for current biasing of the pixel, as well as a reference voltage $V_{REF}$ which is selectively coupled to the monitor/reference current line via a switch 1074 which is controlled by a reset (RST) signal.

The functioning of 4T1C pixel 1000 is substantially similar to that described hereinabove with respect to the 4T1C pixel 500 of FIG. 5. The 4T1C pixel 1000 of FIG. 10, however, operates in current mode in cooperation with biasing circuit 1070, a timing of which operation is described in connection with FIG. 12 hereinbelow.

Figure 11:
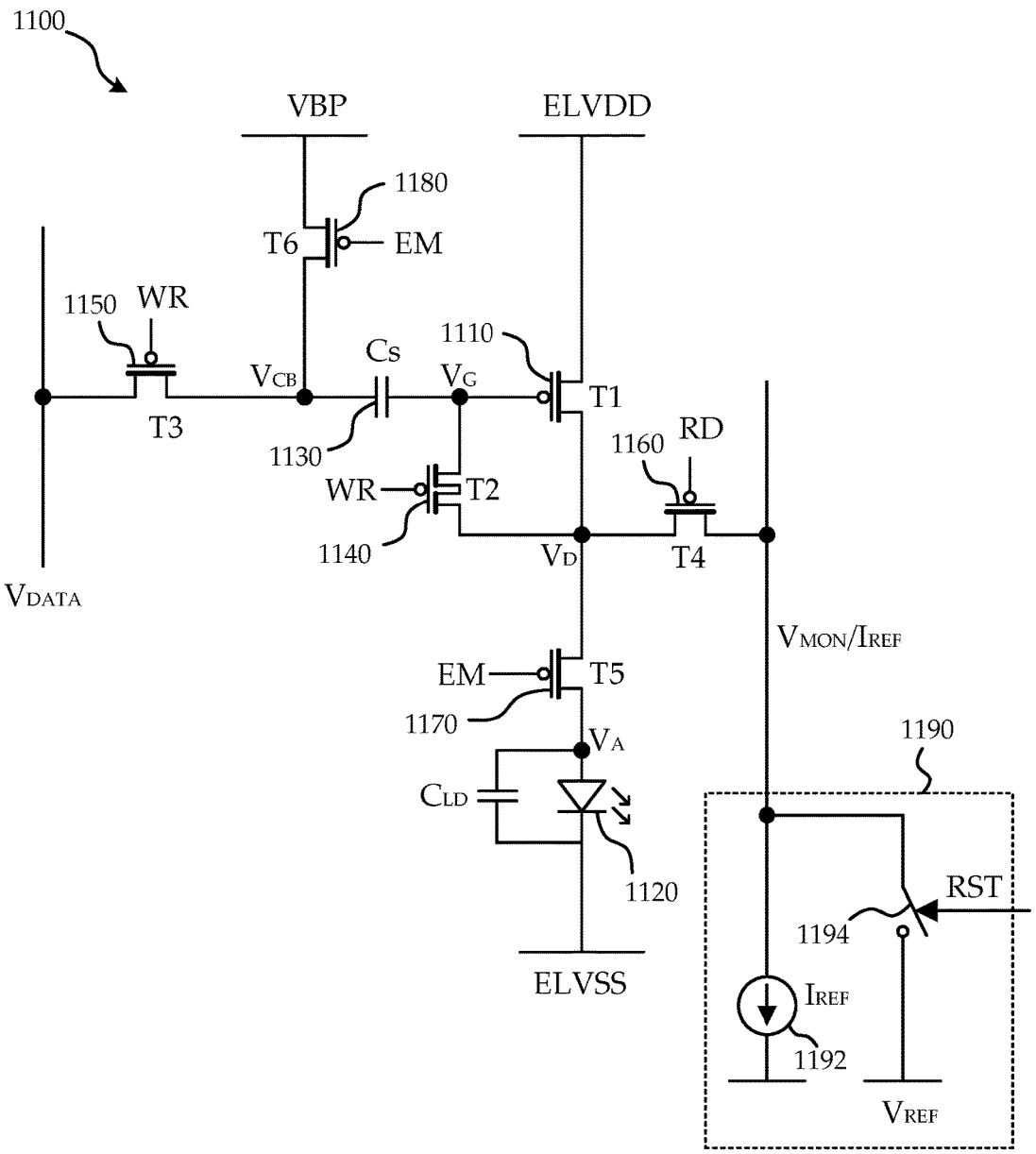
FIG. 11 is a circuit diagram of a 6T1C pixel circuit operated in current mode according to an embodiment.

With reference to FIG. 11, the structure of a six transistor, single capacitor (6T1C) pixel circuit 1100 operated in current mode according to an embodiment will now be described. The 6T1C pixel circuit 1100 corresponds, for example, to a single pixel 110*a* of the display system 150 depicted in FIG. 1. The embodiment depicted in FIG. 11 is a current biased pixel. An associated biasing circuit 1190 for biasing the 6T1C pixel circuit 1100 is illustrated. The biasing circuit 1190 is coupled to the 6T1C pixel circuit 1100 via the monitoring/current bias line ($V_{MON}/I_{REF}$). The 6T1C pixel circuit 1100 depicted in FIG. 11 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The 6T1C pixel circuit 1100 is structured substantially the same as the 6T1C pixel circuit 700 illustrated in FIG. 7. The 6T1C pixel circuit 1100 includes a driving transistor 1110 (T1), a light emitting device 1120, a storage capacitor 1130 ($C_S$), a first switch transistor 1140 (T2), a second switch transistor 1150 (T3), a third switch transistor 1160 (T4), a fourth switch transistor 1170 (T5), and a fifth switch transistor 1180 (T6). Each of the driving transistor 1110, the first switch transistor 1140, the second switch transistor 1150, the third switch transistor 1160, the fourth switch transistor 1170, and the fifth switch transistor 1180, having first, second, and gate terminals, and each of the light emitting device 1120 and the storage capacitor 1130 having first and second terminals.

The gate terminal of the driving transistor 1110 is coupled to a first terminal of the storage capacitor 1130, while the first terminal of the driving transistor 1110 is coupled to a first reference potential ELVDD, and the second terminal of the driving transistor 1110 is coupled to the first terminal of the third switch transistor 1160. The gate terminal of the third switch transistor 1160 is coupled to a read signal line (RD) and the second terminal of the third switch transistor 1160 is coupled to a monitor/reference current line $V_{MON}$/$I_{REF}$. The gate terminal of the fourth switch transistor 1170 is coupled to an emission signal line (EM), while the first terminal of the fourth switch transistor 1170 is coupled to the first terminal of the third switch transistor 1160, and the second terminal of the fourth switch transistor 1170 is coupled to the first terminal of the light emitting device 1120. A second terminal of the light emitting device 1120 is coupled to a second reference potential ELVSS. A capacitance of the light-emitting device 1120 is depicted in FIG. 11 as $C_{LD}$ In some embodiments, the light emitting device 1120 is an OLED. The gate terminal of the first switch transistor 1140 is coupled to a write signal line (WR), while the first terminal of the first switch transistor 1140 is coupled to the first terminal of the storage capacitor 1130, and the second terminal of the first switch transistor 1140 is coupled to the first terminal of the third switch transistor 1160. The gate terminal of the second switch transistor 1150 is coupled to the write signal line (WR), while the first terminal of the second switch transistor 1150 is coupled to a data signal line ($V_{DATA}$), and the second terminal of the second switch transistor 1150 is coupled to the second terminal of the storage capacitor 1130. A node common to the gate terminal of the driving transistor 1110 and the storage capacitor 1130 as well as the first switch transistor 1140 is labelled by its voltage $V_G$ in the figure. The gate terminal of the fifth switch transistor 1180 is coupled to the emission signal line (EM), while the first terminal of the fifth switch transistor 1180 is coupled to VBP, and the second terminal of the fifth switch transistor 1180 is coupled to the second terminal of the storage capacitor 1130. A node common to the second terminal of the storage capacitor 1130, the second switch transistor 1150, and the fifth switch transistor 1180 is labelled by its voltage $V_{CB}$ in FIG. 11.

Coupled to the monitor/reference current line is a biasing circuit 1190, including a current sink 1192 providing reference current $I_{REF}$ for current biasing of the pixel, as well as a reference voltage $V_{REF}$ which is selectively coupled to the monitor/reference current line via a switch 1194 which is controlled by a reset (RST) signal.

Figure 12:
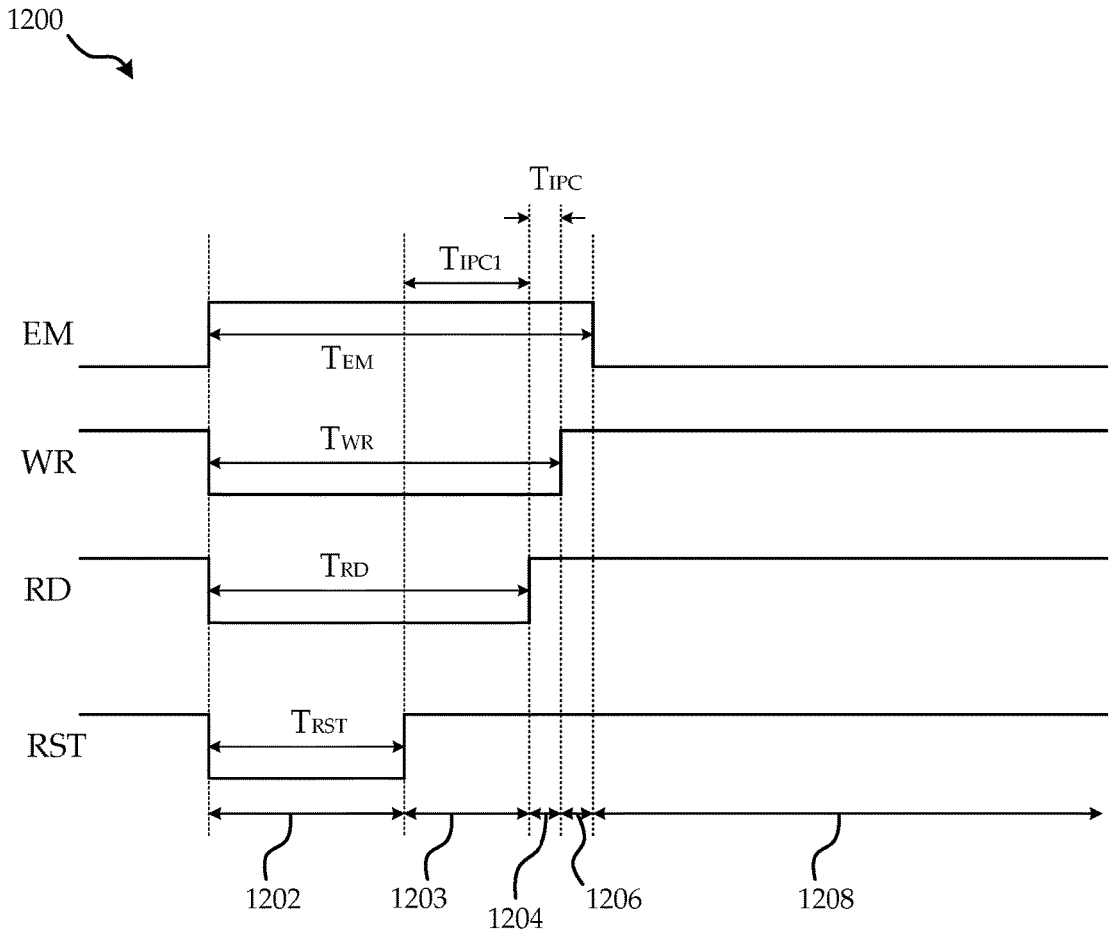
FIG. 12 is a timing diagram illustrating a programming and driving of 4T1C and 6T1C pixel circuits of FIG. 10 and FIG. 11.

With reference also to FIG. 12, an example of a display timing 1200 for the 4T1C pixel circuit 1000 depicted in FIG. 10 and the 6T1C pixel circuit 1100 depicted in FIG. 11 will now be described. The complete display timing 1200 occurs typically once per frame and includes first and second programming cycles 1202, 1203, a calibration cycle 1204, a settling cycle 1206, and an emission cycle 1208. During the first programming cycle 1202 over a period $T_{RST}$ the reset (RST) signal, read signal (RD), and write signal (WR) are held low while the emission (EM) signal is held high. The emission signal (EM) is held high throughout the programming, calibration, and settling cycles 1202, 1203, 1204, 1206 the entire duration thereof $T_{EM}$. During the second programming, calibration, settling, and emission cycles 1203, 1204, 1206, 1208, the 4T1C and 6T1C pixel circuits 1000, 1100 function as described above in connection with FIG. 5 and FIG. 7 with the exception that they are current biased.

For the 4T1C pixel circuit 1000, during the first programming cycle 1202 a reference voltage $V_{REF}$ is coupled through the switch 1174 and the second switch transistor 1040 to the node common to the storage capacitor 1060, the driving transistor 1010, and the third switch transistor 1050, to reset voltage $V_S$ to $V_{REF}$. The voltage of the storage capacitor 1060 and therefore the voltage $V_{SG}$ of the driving transistor 1010 is charged to a value of $V_{REF}-V_{DATA}$ where $V_{REF}$ is a voltage of the monitor line and $V_{DATA}$ is a voltage of the data line. These voltages are set in accordance with a desired programming voltage for causing the pixel 1000 to emit light at a desired luminance according to image data. At the end of the first programming cycle 1202, the rest signal goes high turning off the switch 1074 and disconnecting the monitor/reference current line from the reference voltage $V_{REF}$. After the first programming cycle the read signal stays high allowing the reference current $I_{REF}$ to continue to bias the pixel 1000 during the second programming cycle 1203. To achieve a desirable level of compensation for both threshold and mobility variations, each pixel of a row is driven with a reference current $I_{REF}$ during programming of the pixel, including during both the first and second programming cycles 1202, 1203.

For the 6T1C pixel circuit 1100, during the first programming cycle 1202 a reference voltage $V_{REF}$ is coupled through the switch 1194 and the third switch transistor 1160 to the node common to the first switch transistor 1140, the driving transistor 1110, and the third switch transistor 1160, and the fourth switch transistor 1170, to reset voltage $V_D$ to $V_{REF}$, and the first switch transistor 1140, the second switch transistor 1150, and the third switch transistor 1160 are all on. The voltage of the storage capacitor 1130 $V_{CS}$ is charged to a value of $V_{CB}-V_G=V_{DATA}-(V_{DD}-V_{SG}(T1))\approx V_{DATA}-V_{DD}+V_{th}(T1)$, where $V_{DATA}$ is a voltage on the data line, $V_{DD}$ is the voltage of the first reference potential (also referred to as ELVDD), $V_{SG}(T1)$ the voltage across the gate terminal and the first terminal of the driving transistor 1110, and $V_{th}(T1)$ is a threshold voltage of the driving transistor 1110. Here $V_{DATA}$ set taking into account a desired programming voltage for causing the pixel 1100 to emit light at a desired luminance according to image data.

At the end of the first programming cycle 1202, the rest (RST) signal goes high turning off the switch 1194 and disconnecting the monitor/reference current line from the reference voltage $V_{REF}$. After the first programming cycle 1202 the read signal stays high allowing the reference current source 1192 $I_{REF}$ to continue to bias the pixel 1000 during the second programming cycle 1203. To achieve a desirable level of compensation for both threshold and mobility variations, each pixel of a row is driven with the reference current $I_{REF}$ during programming of the pixel, including during both the first and second programming cycles 1202, 1203.

At the beginning of the calibration cycle 1204, the read line (RD) goes high to turn off the third switch transistor 1260 to discharge some of the voltage (charge) of the storage capacitor 1130 through the driving transistor 1110 and to stop current biasing by the bias circuit 1190. The amount discharged is a function of the characteristics of the driving transistor 1110. For example, if the driving transistor 1110 is "strong", the discharge occurs relatively quickly and relatively more charge is discharged from the storage capacitor 1130 through the driving transistor 1110 during the fixed duration $T_{IPC}$ of the calibration cycle 1204. On the other hand, if the driving transistor 1110 is "weak", the discharge occurs relatively slowly and relatively less charge is discharged from the storage capacitor 1130 through the driving transistor 1110 during the calibration cycle 1204. As a result, the voltage (charge) stored in the storage capacitor 1130 is reduced comparatively more for relatively strong driving transistors versus comparatively less for relatively weak driving transistors, thereby providing some compensation for non-uniformity and variations in the driving transistors across the display whether due to variations in fabrication or variations in degradation over time.

After the calibration cycle 1204, a settling cycle 1206 is performed prior to the emission cycle 1208. During the settling cycle 1206 the third, fourth, and fifth switch transistors 1160, 1170, and 1180 remain off, while the write signal (WR) goes high to also turn off the first and second switch transistors 1140, 1150. After completion of the duration of the settling cycle 1206 at the start of the emission cycle 1208, the emission signal (EM) goes low turning on the fourth and fifth switch transistors 1170, 1180. This causes the driving transistor 1110 to be driven with a voltage $V_{SG}=V_{DD}-V_G=V_{DD}-(VBP-V_{CS})=V_{DD}-VBP+V_{DATA}-V_{DD}+V_{th}(T1)=V_{DATA}+V_{th}(T1)-VBP$. This allows current to flow through the light emitting device 1120 according to the calibrated stored voltage on the storage capacitor 1130, and which is also a function of the threshold voltage $V_{th}(T1)$ of the driving transistor 1110 and which is independent of $V_{DD}$.

Figure 13:
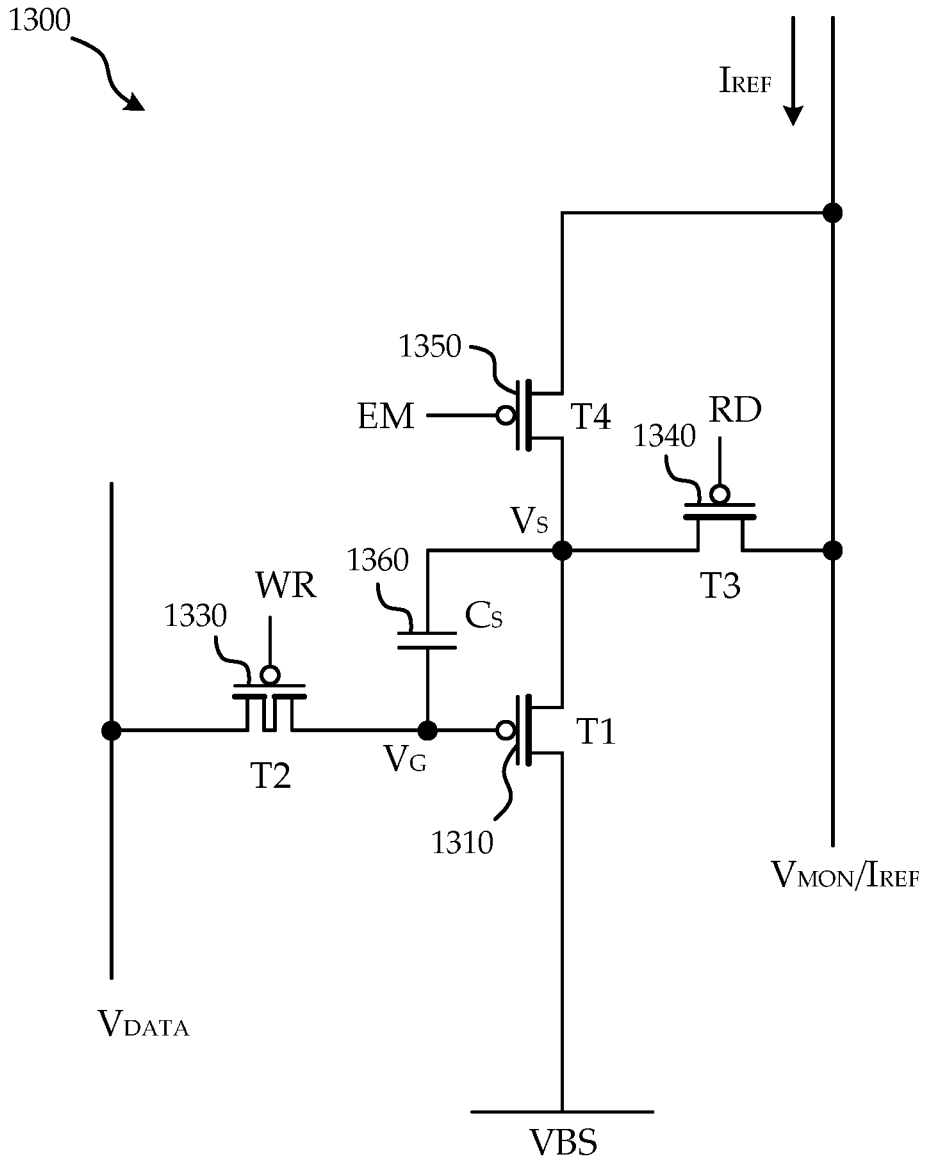
FIG. 13 is a circuit diagram of a 4T1C reference current sink according to an embodiment.

With reference to FIG. 13, the structure of a four transistor, single capacitor (4T1C) reference current sink 1300 according to an embodiment will now be described. The 4T1C reference current sink 1300 corresponds, for example, to a sink 155*a* of the display system 150 depicted in FIG. 1 or a sink 1192 depicted in FIG. 11. The 4T1C reference current sink 1300 depicted in FIG. 13 is based on NMOS transistors. It should be understood that variations of this sink and its functioning are contemplated and include different types of transistors (PMOS, NMOS, or CMOS) and different semiconductor materials (e.g., LTPS, Metal Oxide, etc.).

The 4T1C reference current sink 1300 includes a driving transistor 1310 (T1), a first switch transistor 1330 (T2), a second switch transistor 1340 (T3), a third switch transistor 1350 (T4), and a storage capacitor 1360 ($C_S$). Each of the driving transistor 1310, the first switch transistor 1330, the second switch transistor 1340, and the third switch transistor 1350 having first, second, and gate terminals, and the storage capacitor 1360 having first and second terminals.

The gate terminal of the driving transistor 1310 is coupled to a first terminal of the storage capacitor 1360, while the first terminal of the driving transistor 1310 is coupled to the second terminal of the storage capacitor 1360, and the second terminal of the driving transistor 1310 is coupled to a reference potential VBS. The gate terminal of the first switch transistor 1330 is coupled to a write signal line (WR), while the first terminal of the first switch transistor 1330 is coupled to a data signal line ($V_{DATA}$), and the second terminal of the first switch transistor 1330 is coupled to the gate terminal of the driving transistor 1310. A node common to the gate terminal of the driving transistor 1310 and the storage capacitor 1360 as well as the first switch transistor 1330 is labelled by its voltage $V_G$ in the figure. The gate terminal of the second switch transistor 1340 is coupled to a read signal line (RD), while the first terminal of the second switch transistor 1340 is coupled to a monitor signal line ($V_{MON}$), and the second terminal of the second switch transistor 1340 is coupled to the second terminal of the storage capacitor 1360. The gate terminal of the third switch transistor 1350 is coupled to an emission signal line (EM), while the first terminal of the third switch transistor 1350 is coupled to the monitor signal line, and the second terminal of the third switch transistor 1350 is coupled to the second terminal of the storage capacitor 1360. A node common to the second terminal of the storage capacitor 1360, the driving transistor 1310, the second switch transistor 1340, and the third switch transistor 1350 is labelled by its voltage $V_S$ in the figure.

The functioning of the 4T1C reference current sink 1300 will be described in connection with the timing diagram of FIG. 17 discussed hereinbelow.

Figure 14:
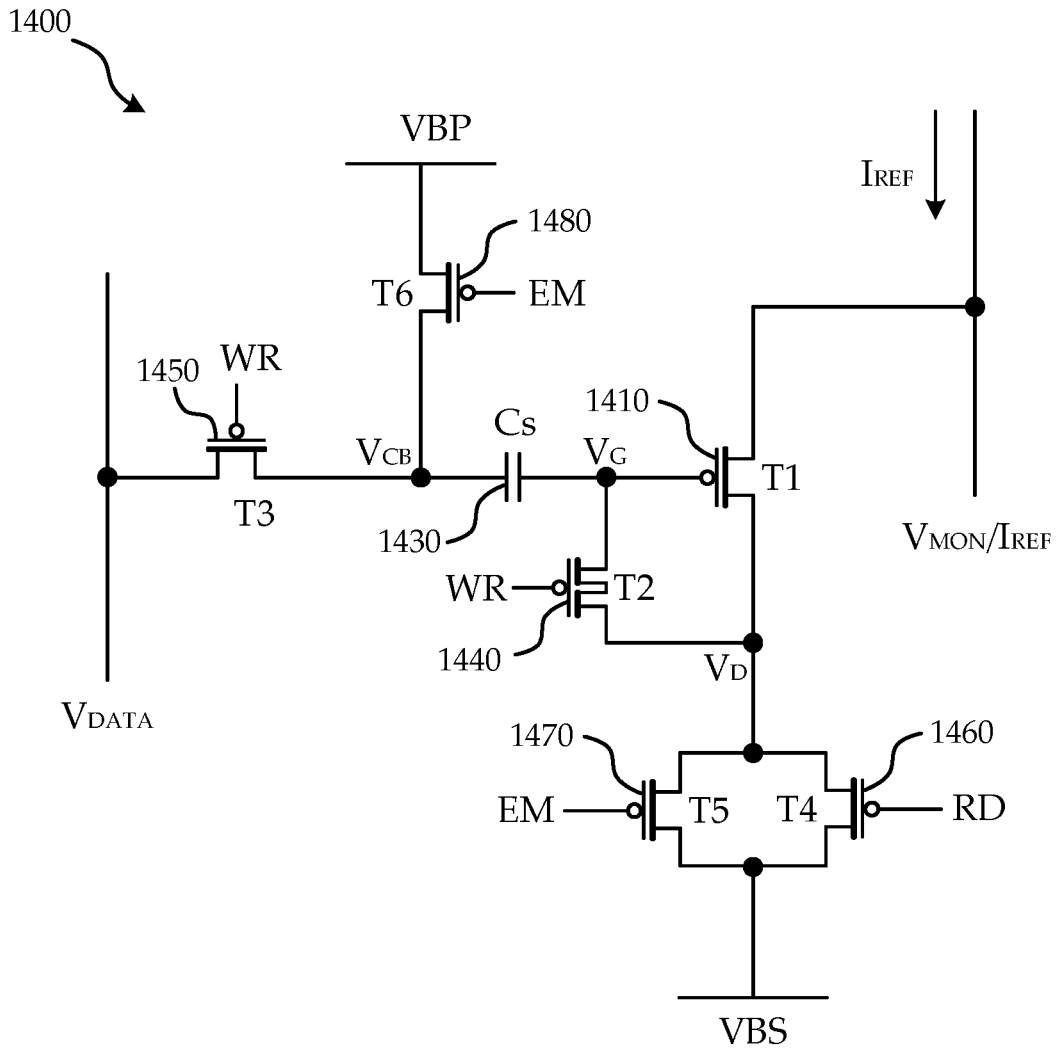
FIG. 14 is a circuit diagram of a 6T1C reference current sink according to an embodiment.

With reference to FIG. 14, the structure of a six transistor, single capacitor (6T1C) reference current sink 1400 according to an embodiment will now be described. The 6T1C reference current sink 1400 corresponds, for example, to a sink 155*a* of the display system 150 depicted in FIG. 1 or a sink 1192 depicted in FIG. 11. The 6T1C reference current sink 1400 depicted in FIG. 14 is based on NMOS transistors. It should be understood that variations of this sink and its functioning are contemplated and include different types of transistors (PMOS, NMOS, or CMOS) and different semiconductor materials (e.g. LTPS, Metal Oxide, etc.).

The 6T1C reference current sink 1400 includes a driving transistor 1410 (T1), a storage capacitor 1430 ($C_S$), a first switch transistor 1440 (T2), a second switch transistor 1450 (T3), a third switch transistor 1460 (T4), a fourth switch transistor 1470 (T5), and a fifth switch transistor 1480 (T6). Each of the driving transistor 1410, the first switch transistor 1440, the second switch transistor 1450, the third switch transistor 1460, the fourth switch transistor 1470, and the fifth switch transistor 1480, having first, second, and gate terminals, and the storage capacitor 1430 having first and second terminals.

The gate terminal of the driving transistor 1410 is coupled to a first terminal of the storage capacitor 1430, while the first terminal of the driving transistor 1410 is coupled to the monitor/current reference line ($V_{MON}/I_{REF}$), and the second terminal of the driving transistor 1410 is coupled to the first terminal of the third switch transistor 1460. The gate terminal of the third switch transistor 1460 is coupled to a read signal line (RD) and the second terminal of the third switch transistor 1460 is coupled to VBS. The gate terminal of the fourth switch transistor 1470 is coupled to an emission signal line (EM), while the first terminal of the fourth switch transistor 1470 is coupled to the first terminal of the third switch transistor 1460, and the second terminal of the fourth switch transistor 1470 is coupled to the second terminal of the third switch transistor 1460. The gate terminal of the first switch transistor 1440 is coupled to a write signal line (WR), while the first terminal of the first switch transistor 1440 is coupled to the first terminal of the storage capacitor 1430, and the second terminal of the first switch transistor 1440 is coupled to the first terminal of the third switch transistor 1460. The gate terminal of the second switch transistor 1450 is coupled to the write signal line (WR), while the first terminal of the second switch transistor 1450 is coupled to a data signal line ($V_{DATA}$), and the second terminal of the second switch transistor 1450 is coupled to the second terminal of the storage capacitor 1430. A node common to the gate terminal of the driving transistor 1410 and the storage capacitor 1430 as well as the first switch transistor 1440 is labelled by its voltage $V_G$ in the figure. The gate terminal of the fifth switch transistor 1480 is coupled to the emission signal line (EM), while the first terminal of the fifth switch transistor 1480 is coupled to VBP, and the second terminal of the fifth switch transistor 1480 is coupled to the second terminal of the storage capacitor 1430. A node common to the second terminal of the storage capacitor 1430, the second switch transistor 1450, and the fifth switch transistor 1480 is labelled by its voltage $V_{CB}$ in FIG. 14.

The functioning of the 6T1C reference current sink 1400 will be described in connection with the timing diagram of FIG. 17 discussed hereinbelow.

Figure 15:
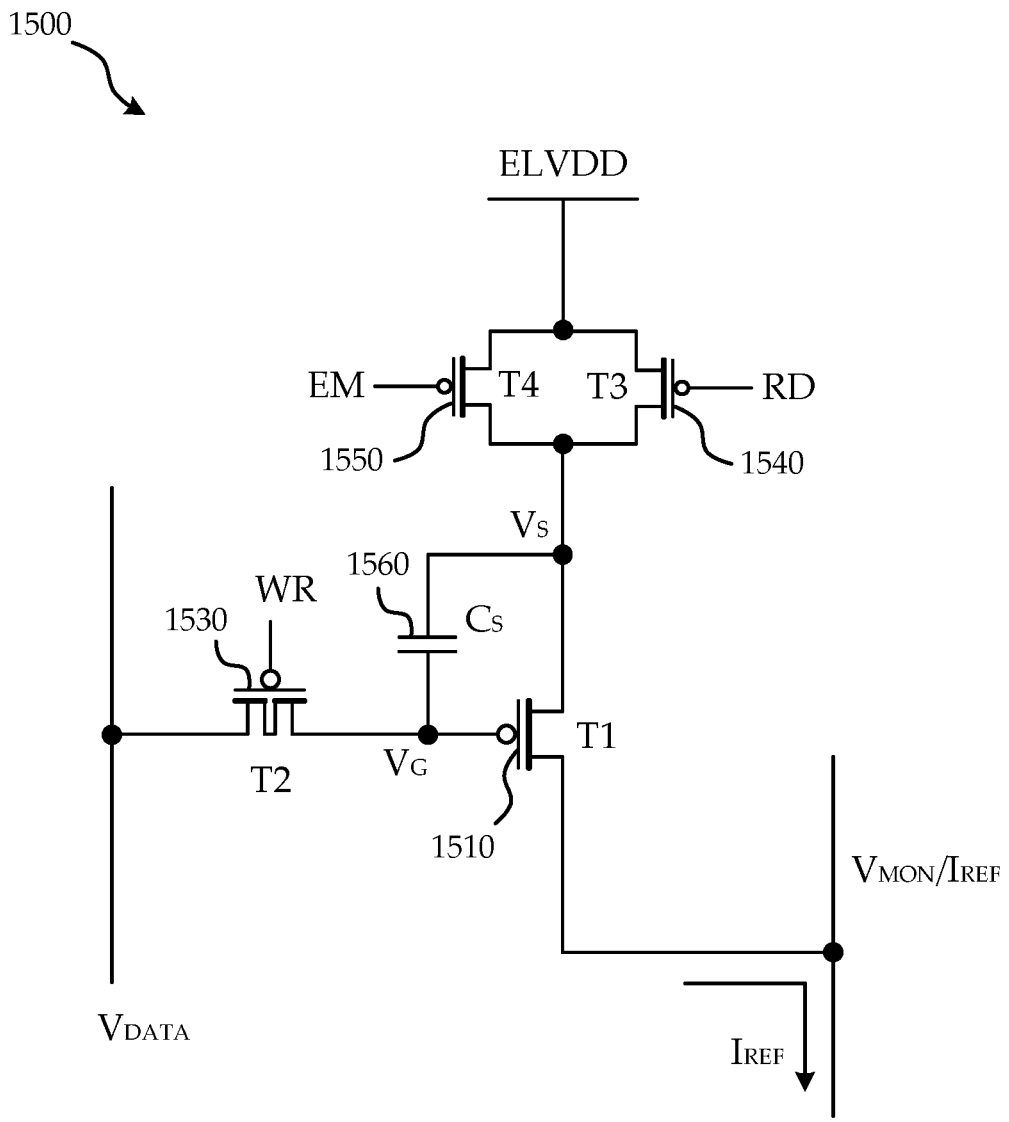
FIG. 15 is a circuit diagram of a 4T1C reference current source according to an embodiment.

With reference to FIG. 15, the structure of a four transistor, single capacitor (4T1C) reference current source 1500 according to an embodiment will now be described. The 4T1C reference current source 1500 corresponds, for example, to a source 155*a* of the display system 150 depicted in FIG. 1 or a source 1072 depicted in FIG. 10. The 4T1C reference current source 1500 depicted in FIG. 15 is based on NMOS transistors. It should be understood that variations of this source and its functioning are contemplated and include different types of transistors (PMOS, NMOS, or CMOS) and different semiconductor materials (e.g. LTPS, Metal Oxide, etc.).

The 4T1C reference current source 1500 includes a driving transistor 1510 (T1), a first switch transistor 1530 (T2), a second switch transistor 1540 (T3), a third switch transistor 1550 (T4), and a storage capacitor 1560 ($C_S$). Each of the driving transistor 1510, the first switch transistor 1530, the second switch transistor 1540, and the third switch transistor 1550 having first, second, and gate terminals, and the storage capacitor 1560 having first and second terminals.

The gate terminal of the driving transistor 1510 is coupled to a first terminal of the storage capacitor 1560, while the first terminal of the driving transistor 1510 is coupled to the second terminal of the storage capacitor 1560, and the second terminal of the driving transistor 1510 is coupled to a monitor/reference current line $V_{MON}/I_{REF}$. The gate terminal of the first switch transistor 1530 is coupled to a write signal line (WR), while the first terminal of the first switch transistor 1530 is coupled to a data signal line ($V_{DATA}$), and the second terminal of the first switch transistor 1530 is coupled to the gate terminal of the driving transistor 1510. A node common to the gate terminal of the driving transistor 1510 and the storage capacitor 1560 as well as the first switch transistor 1530 is labelled by its voltage $V_G$ in the figure. The gate terminal of the second switch transistor 1540 is coupled to a read signal line (RD), while the first terminal of the second switch transistor 1540 is coupled to a reference potential (ELVDD), and the second terminal of the second switch transistor 1540 is coupled to the second terminal of the storage capacitor 1560. The gate terminal of the third switch transistor 1550 is coupled to an emission signal line (EM), while the first terminal of the third switch transistor 1550 is coupled to ELVDD, and the second terminal of the third switch transistor 1550 is coupled to the second terminal of the storage capacitor 1560. A node common to the second terminal of the storage capacitor 1560, the driving transistor 1510, the second switch transistor 1540, and the third switch transistor 1550 is labelled by its voltage $V_S$ in the figure.

The functioning of the 4T1C reference current source 1500 will be described in connection with the timing diagram of FIG. 17 discussed hereinbelow.

Figure 16:
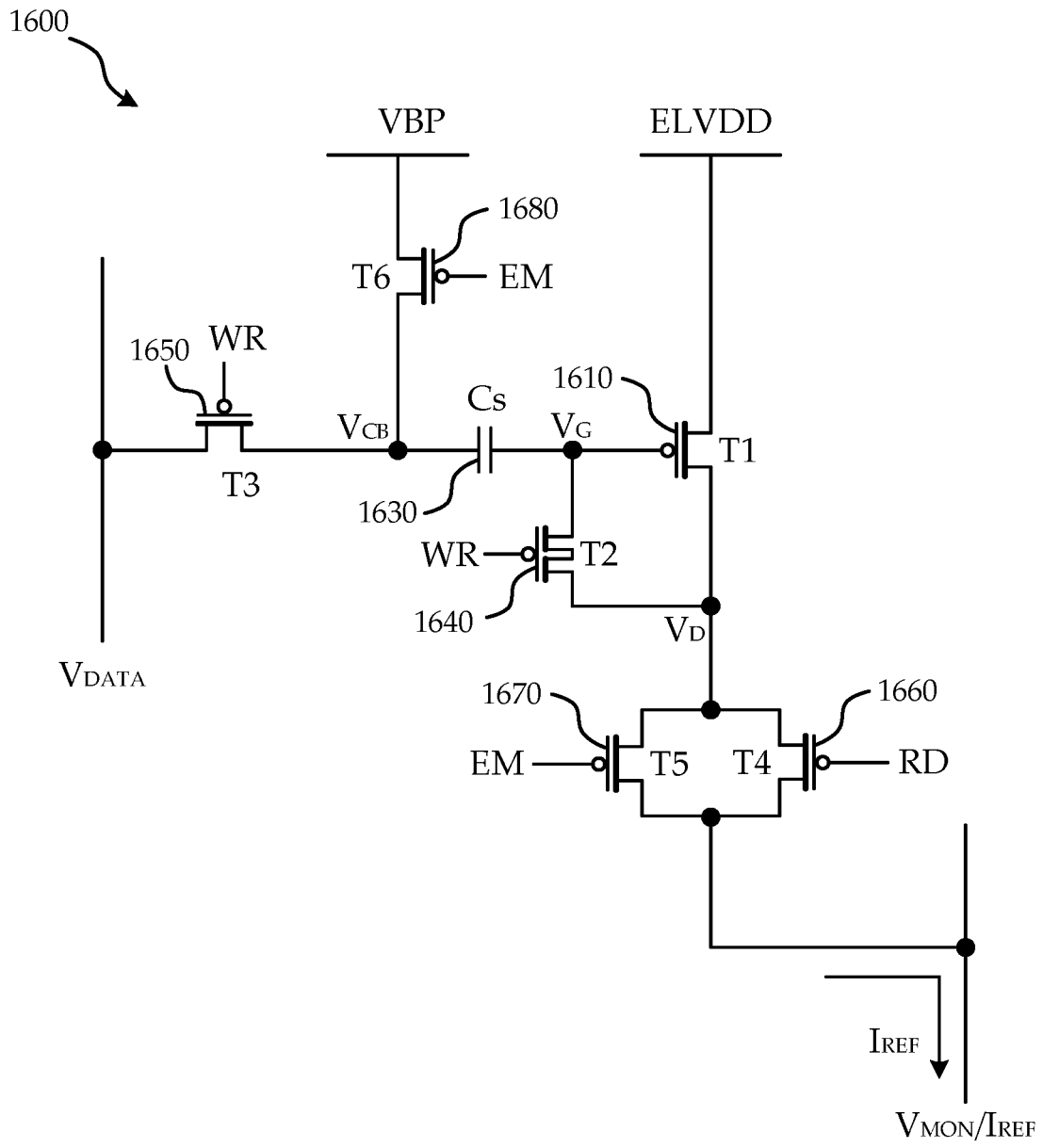
FIG. 16 is a circuit diagram of a 6T1C reference current source according to an embodiment.

With reference to FIG. 16, the structure of a six transistor, single capacitor (6T1C) reference current source 1600 according to an embodiment will now be described. The 6T1C reference current source 1600 corresponds, for example, to a source 155*a* of the display system 150 depicted in FIG. 1 or a source 1072 depicted in FIG. 10. The 6T1C reference current source 1600 depicted in FIG. 16 is based on NMOS transistors. It should be understood that variations of this source and its functioning are contemplated and include different types of transistors (PMOS, NMOS, or CMOS) and different semiconductor materials (e.g., LTPS, Metal Oxide, etc.).

The 6T1C reference current source 1600 includes a driving transistor 1610 (T1), a storage capacitor 1630 ($C_S$), a first switch transistor 1640 (T2), a second switch transistor 1650 (T3), a third switch transistor 1660 (T4), a fourth switch transistor 1670 (T5), and a fifth switch transistor 1680 (T6). Each of the driving transistor 1610, the first switch transistor 1640, the second switch transistor 1650, the third switch transistor 1660, the fourth switch transistor 1670, and the fifth switch transistor 1680, having first, second, and gate terminals, and the storage capacitor 1630 having first and second terminals.

The gate terminal of the driving transistor 1610 is coupled to a first terminal of the storage capacitor 1630, while the first terminal of the driving transistor 1610 is coupled to a reference potential (ELVSS), and the second terminal of the driving transistor 1610 is coupled to the first terminal of the third switch transistor 1660. The gate terminal of the third switch transistor 1660 is coupled to a read signal line (RD) and the second terminal of the third switch transistor 1660 is coupled to a monitor/reference current line $V_{MON}/I_{REF}$. The gate terminal of the fourth switch transistor 1670 is coupled to an emission signal line (EM), while the first terminal of the fourth switch transistor 1670 is coupled to the first terminal of the third switch transistor 1660, and the second terminal of the fourth switch transistor 1670 is coupled to the second terminal of the third switch transistor 1660. The gate terminal of the first switch transistor 1640 is coupled to a write signal line (WR), while the first terminal of the first switch transistor 1640 is coupled to the first terminal of the storage capacitor 1630, and the second terminal of the first switch transistor 1640 is coupled to the first terminal of the third switch transistor 1660. The gate terminal of the second switch transistor 1650 is coupled to the write signal line (WR), while the first terminal of the second switch transistor 1650 is coupled to a data signal line ($V_{DATA}$), and the second terminal of the second switch transistor 1650 is coupled to the second terminal of the storage capacitor 1630. A node common to the gate terminal of the driving transistor 1610 and the storage capacitor 1630 as well as the first switch transistor 1640 is labelled by its voltage $V_G$ in the figure. The gate terminal of the fifth switch transistor 1680 is coupled to the emission signal line (EM), while the first terminal of the fifth switch transistor 1680 is coupled to VBP, and the second terminal of the fifth switch transistor 1680 is coupled to the second terminal of the storage capacitor 1630. A node common to the second terminal of the storage capacitor 1630, the second switch transistor 1650, and the fifth switch transistor 1680 is labelled by its voltage $V_{CB}$ in FIG. 16.

The functioning of the 6T1C reference current source 1600 will be described in connection with the timing diagram of FIG. 17 discussed hereinbelow.

Figure 17:
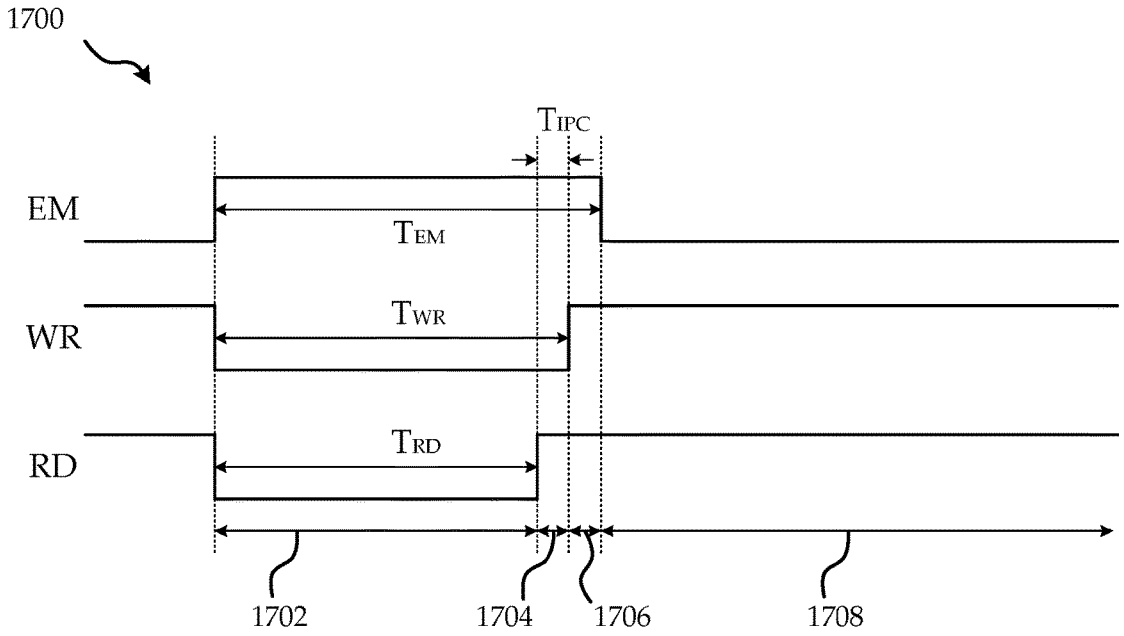
FIG. 17 is a reference row timing diagram illustrating a programming and driving of 4T1C, 6T1C, sinks and sources of FIGS. 13, 14, 15, and 16.

With reference also to FIG. 17, an example of a reference row timing 1700 for the 4T1C reference current sink 1300 depicted in FIG. 13, the 6T1C reference current sink 1400 depicted in FIG. 14, the 4T1C reference current source 1500 depicted in FIG. 15, and the 6T1C reference current source 1600 depicted in FIG. 16 will now be described. All of these current sinks and sources 1300, 1400, 1500, 1600, use the same control signals (EM, WR, RD) and similar timing as the active rows, making them convenient for integration in the display panel for example at the first or the last row of the display panel. It should be noted that since the pixel circuits, which are current biased during programming, use as their input the bias current provided by the current sources (or sinks) and since after those sources and sinks themselves have been programmed, appropriate delays and synchronization is used to ensure programming of the sources and sinks occur at times when bias currents are not needed by the pixels and to ensure provision of biasing currents at times when required by the pixels.

The complete display timing 1700 occurs typically once per frame and includes programming cycle 1702, a calibration cycle 1704, a settling cycle 1706, and an emission cycle 1708. During the programming cycle 1702 the read signal (RD), and write signal (WR) are held low while the emission (EM) signal is held high. The emission signal (EM) is held high throughout the programming, calibration, and settling cycles 1202, 1204, 1206 for the entire duration thereof $T_{EM}$.

For the 4T1C reference current sink 1300 depicted in FIG. 13, during the programming cycle 1702, the first switch transistor 1330 and the second switch transistor 1340 are both on. The voltage of the storage capacitor 1360 and therefore the voltage $V_{SG}$ of the driving transistor 1310 is charged to a value of $V_{MON}-V_{DATA}$ where $V_{MON}$ is a voltage of the monitor line and $V_{DATA}$ is a voltage of the data line. These voltages are set in accordance with a desired programming voltage for causing the reference current sink 1300 to generate a reference current at a desired level.

At the beginning of the calibration cycle 1704, the read line (RD) goes high to turn off the second switch transistor 1340 to discharge some of the voltage (charge) of the storage capacitor 1360 through the driving transistor 1310. The amount discharged is a function of the characteristics of the driving transistor 1310. For example, if the driving transistor 1310 is "strong," the discharge occurs relatively quickly and relatively more charge is discharged from the storage capacitor 1360 through the driving transistor 1310 during the fixed duration $T_{IPC}$ of the calibration cycle 1704. On the other hand, if the driving transistor 1310 is "weak," the discharge occurs relatively slowly and relatively less charge is discharged from the storage capacitor 1360 through the driving transistor 1310 during the calibration cycle 1704. As a result, the voltage (charge) stored in the storage capacitor 1360 is reduced comparatively more for relatively strong driving transistors versus comparatively less for relatively weak driving transistors, thereby providing some compensation for non-uniformity and variations in the reference currents being provided across the display whether due to variations in fabrication or variations in degradation over time.

After the calibration cycle 1704, a settling cycle 1706 is performed prior to the emission. During the settling cycle 1706 the second and third switch transistors 1340, 1350 remain off, while the write signal (WR) goes high to also turn off the first switch transistor 1330. After completion of the duration of the settling cycle 1706 at the start of the emission cycle 1708, the emission signal (EM) goes low turning on the third switch transistor 1350 allowing reference current $I_{REF}$ to be provided to the monitor/reference current line according to the calibrated stored voltage on the storage capacitor 1360.

For the 6T1C reference current sink 1400 depicted in FIG. 14, during the programming cycle 1702 the first switch transistor 1440, the second switch transistor 1450, and the third switch transistor 1460 are all on. The voltage of the storage capacitor 1430 $V_{CS}$ is charged to a value of $V_{CB}-V_G=V_{DATA}-(V_{MON}-V_{SG}(T1))\approx V_{DATA}-V_{MON}+V_{th}(T1)$, where $V_{DATA}$ is a voltage on the data line, $V_{MON}$ is the voltage on the monitor/reference current line, $V_{SG}(T1)$ the voltage across the gate terminal and the first terminal of the driving transistor 1410, and $V_{th}(T1)$ is a threshold voltage of the driving transistor 1410. Here $V_{DATA}$ is set taking into account a desired programming voltage for causing the reference current sink 1400 to generate a reference current at a desired level.

At the beginning of the calibration cycle 1704, the read line (RD) goes high to turn off the third switch transistor 1460 to discharge some of the voltage (charge) of the storage capacitor 1430 through the driving transistor 1410. The amount discharged is a function of the characteristics of the driving transistor 1410. For example, if the driving transistor 1410 is "strong", the discharge occurs relatively quickly and relatively more charge is discharged from the storage capacitor 1430 through the driving transistor 1410 during the fixed duration $T_{IPC}$ of the calibration cycle 1704. On the other hand, if the driving transistor 1410 is "weak," the discharge occurs relatively slowly and relatively less charge is discharged from the storage capacitor 1430 through the driving transistor 1410 during the calibration cycle 1704. As a result, the voltage (charge) stored in the storage capacitor 1430 is reduced comparatively more for relatively strong driving transistors versus comparatively less for relatively weak driving transistors, thereby providing some compensation for non-uniformity and variations in the current sinks 1400 across the display whether due to variations in fabrication or variations in degradation over time.

After the calibration cycle 1704, a settling cycle 1706 is performed prior to the emission cycle 1708. During the settling cycle 1706 the third, fourth, and fifth switch transistors 1460, 1470, and 1480 remain off, while the write signal (WR) goes high to also turn off the first and second switch transistors 1440, 1450. After completion of the duration of the settling cycle 1706 at the start of the emission cycle 1708, the emission signal (EM) goes low turning on the fourth and fifth switch transistors 1470, 1480. This causes the driving transistor 1410 to be driven with a voltage $V_{SG}=V_{MON}-V_G=V_{MON}-(VBP-V_{CS})=V_{MON}-VBP+V_{DATA}-V_{MON}+V_{th}(T1)=V_{DATA}+V_{th}(T1)-VBP$. This allows reference current $I_{REF}$ to be provided to the monitor/reference current line according to the calibrated stored voltage on the storage capacitor 1430, and which is also a function of the threshold voltage $V_{th}(T1)$ of the driving transistor 1410 and which is independent of $V_{MON}$ and independent of $V_{DD}$.

For the 4T1C reference current source 1500 depicted in FIG. 15, during the programming cycle 1702, the first switch transistor 1530 and the second switch transistor 1540 are both on. The voltage of the storage capacitor 1560 and therefore the voltage $V_{SG}$ of the driving transistor 1510 is charged to a value of $V_{DD}-V_{DATA}$ where $V_{DD}$ is a voltage of the reference potential ELVDD line and $V_{DATA}$ is a voltage of the data line. At least one of these voltages are set in accordance with a desired programming voltage for causing the reference current source 1500 to generate a reference current at a desired level.

At the beginning of the calibration cycle 1704, the read line (RD) goes high to turn off the second switch transistor 1540 to discharge some of the voltage (charge) of the storage capacitor 1560 through the driving transistor 1510. The amount discharged is a function of the characteristics of the driving transistor 1510. For example, if the driving transistor 1510 is "strong," the discharge occurs relatively quickly and relatively more charge is discharged from the storage capacitor 1560 through the driving transistor 1510 during the fixed duration $T_{IPC}$ of the calibration cycle 1704. On the other hand, if the driving transistor 1510 is "weak," the discharge occurs relatively slowly and relatively less charge is discharged from the storage capacitor 1560 through the driving transistor 1510 during the calibration cycle 1704. As a result, the voltage (charge) stored in the storage capacitor 1560 is reduced comparatively more for relatively strong driving transistors versus comparatively less for relatively weak driving transistors, thereby providing some compensation for non-uniformity and variations in the reference currents being provided across the display whether due to variations in fabrication or variations in degradation over time.

After the calibration cycle 1704, a settling cycle 1706 is performed prior to the emission cycle. During the settling cycle 1706 the second and third switch transistors 1540, 1550 remain off, while the write signal (WR) goes high to also turn off the first switch transistor 1530. After completion of the duration of the settling cycle 1706 at the start of the emission cycle 1708, the emission signal (EM) goes low turning on the third switch transistor 1550 allowing reference current $I_{REF}$ to be provided to the monitor/reference current line according to the calibrated stored voltage on the storage capacitor 1560.

For and the 6T1C reference current source 1600 depicted in FIG. 16, during the programming cycle 1702 the first switch transistor 1640, the second switch transistor 1650, and the third switch transistor 1660 are all on. The voltage of the storage capacitor 1630 $V_{CS}$ is charged to a value of $V_{CB}-V_G=V_{DATA}-(V_{DD}-V_{SG}(T1))\approx V_{DATA}-V_{DD}+V_{th}(T1)$, where $V_{DATA}$ is a voltage on the data line, $V_{DD}$ is the voltage of the reference potential ELVDD, $V_{SG}(T1)$ the voltage across the gate terminal and the first terminal of the driving transistor 1610, and $V_{th}(T1)$ is a threshold voltage of the driving transistor 1610. Here $V_{DATA}$ is set taking into account a desired programming voltage for causing the reference current source 1600 to generate a reference current at a desired level.

At the beginning of the calibration cycle 1704, the read line (RD) goes high to turn off the third switch transistor 1660 to discharge some of the voltage (charge) of the storage capacitor 1630 through the driving transistor 1610. The amount discharged is a function of the characteristics of the driving transistor 1610. For example, if the driving transistor 1610 is "strong," the discharge occurs relatively quickly and relatively more charge is discharged from the storage capacitor 1630 through the driving transistor 1610 during the fixed duration $T_{IPC}$ of the calibration cycle 1704. On the other hand, if the driving transistor 1610 is "weak," the discharge occurs relatively slowly and relatively less charge is discharged from the storage capacitor 1630 through the driving transistor 1610 during the calibration cycle 1704. As a result, the voltage (charge) stored in the storage capacitor 1630 is reduced comparatively more for relatively strong driving transistors versus comparatively less for relatively weak driving transistors, thereby providing some compensation for non-uniformity and variations in the current sources 1600 across the display whether due to variations in fabrication or variations in degradation over time.

After the calibration cycle 1704, a settling cycle 1706 is performed prior to the emission cycle 1708. During the settling cycle 1706 the third, fourth, and fifth switch transistors 1660, 1670, and 1680 remain off, while the write signal (WR) goes high to also turn off the first and second switch transistors 1640, 1650. After completion of the duration of the settling cycle 1706 at the start of the emission cycle 1708, the emission signal (EM) goes low turning on the fourth and fifth switch transistors 1670, 1680. This causes the driving transistor 1610 to be driven with a voltage $V_{SG}=V_{DD}-V_G=V_{DD}-(VBP-V_{CS})=V_{DD}-VBP+V_{DATA}-V_{DD}+V_{th}(T1)=V_{DATA}+V_{th}(T1)-VBP$. This allows reference current $I_{REF}$ to be provided to the monitor/reference current line according to the calibrated stored voltage on the storage capacitor 1630, and which is also a function of the threshold voltage $V_{th}(T1)$ of the driving transistor 1610 and which is independent of $V_{DD}$.

Figure 18:
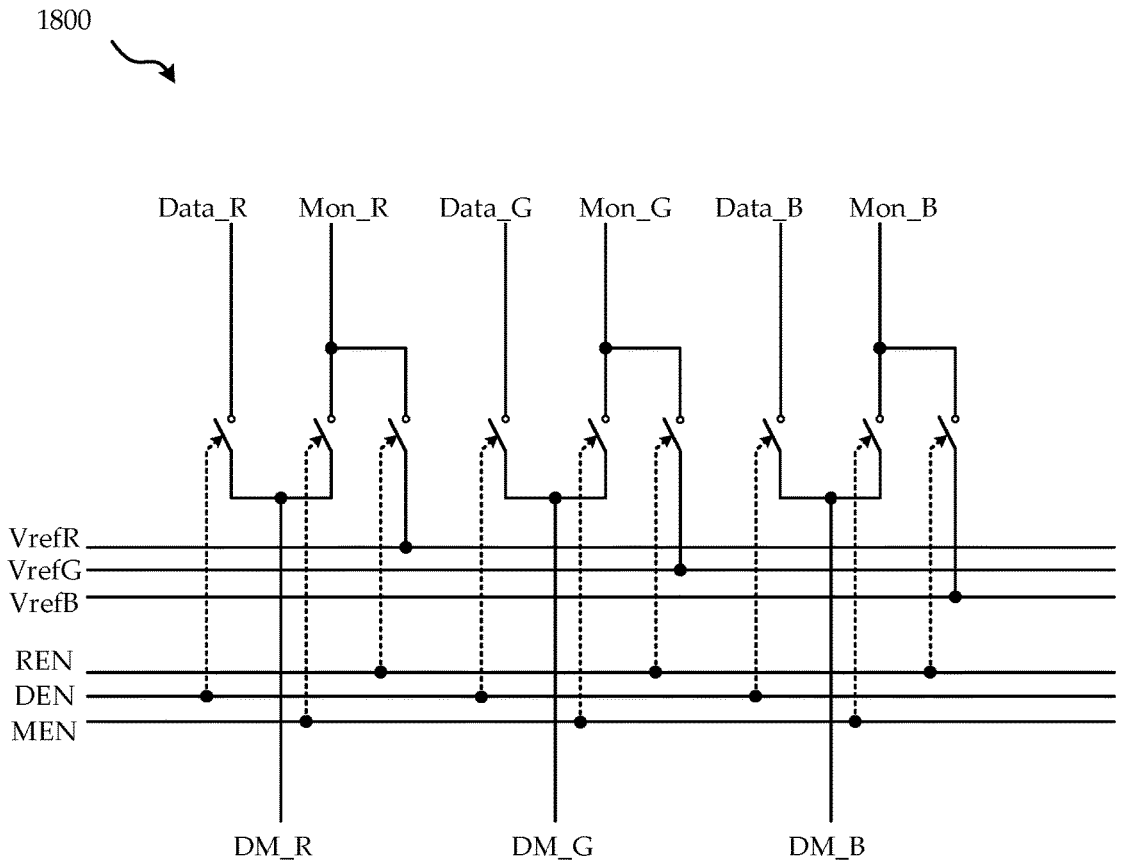
FIG. 18 is a schematic diagram of on-panel multiplexing of data and monitor lines.

With reference to FIG. 18, on-panel multiplexing 1800 of data and monitor lines will now be discussed. A driver chip (not shown) provides driver signals over data/monitor lines DM_R, DM_G, and DM_B for red, green, and blue pixels of, for example, a column. Each of these lines is connected via two switches to a separate respective data and monitor lines. For example, DM_R is coupled to Data_R and Mon_R for red subpixels, DM_G is coupled to Data_G and Mon_G for green subpixels, and DM_B is coupled to Data_B and Mon_B for blue subpixels. The switches demultiplexing the DM_X signals on the Data_X and Mon_X lines and are controlled respectively by a data enable (DEN) signal line (corresponding to the WR signal described herein) and a monitor enable (MEN) signal line (corresponding to the RD signal described herein). Each monitor line is connected via an additional switch to a separate reference voltage. For example MON_R is coupled to VrefR, MON_G is coupled to VrefG, and MON_B is coupled to VrefB. These respective additional switches coupling the monitor lines to the respective reference voltages are controlled by a reset enable (REN) signal line (corresponding to the RST signal described herein). The multiplexing provides a reduction in the I/O count of the driver chip (not shown).

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A system for generating currents for pixels of an emissive display system, each pixel having a light-emitting device, the system comprising:

a plurality of pixels;

a plurality of current generating circuits for providing a current for at least one respective pixel; and a controller coupled to said current generating circuits for controlling said current generating circuits over a plurality of signal lines;

wherein each current generating circuit comprises:

at least one driving transistor for providing the current for the pixel; and a storage capacitance for being programmed and for setting a magnitude of the current provided by the at least one driving transistor;

wherein the controller's controlling each current generating circuit comprises:

during a programming cycle charging the storage capacitance to a defined level; and subsequent to the programming cycle, during a calibration cycle, partially discharging the storage capacitance as a function of characteristics of the at least one driving transistor.

2. The system of claim 1, wherein the at least one driving transistor comprises a driving transistor and the controller's controlling each current generating circuit further comprises:

during the programming cycle charging the storage capacitance connected to a gate terminal of the driving transistor to include at least a threshold voltage of the driving transistor, such that during an emission cycle, a voltage across the source terminal and the drain terminal during the emission cycle is a function of the threshold voltage of the driving transistor.

3. The system of claim 1, wherein the at least one driving transistor comprises a driving transistor and the controller's controlling each current generating circuit further comprises:

during the programming cycle charging the storage capacitance connected to a gate terminal of the driving transistor to include at least a first voltage applied to a source terminal of the driving transistor, such that during an emission cycle, during which a first voltage is maintained at the source terminal of the driving transistor, a voltage across the source terminal and the drain terminal is independent of the first voltage.

4. The system of claim 3, wherein the first voltage is one of $V_{DD}$ and $V_{MON}$.

5. The system of claim 1, wherein each current generating circuit comprises one of a reference current sink and a reference current source for providing the current for the at least one respective pixels, the current provided to provide reference current biasing for the at least one respective pixels.

6. The system of claim 1, wherein each pixel comprises the current generating circuit for providing the current for said pixel, the current provided to drive the light-emitting device of said pixel.

7. The system of claim 6, wherein the light emitting device is an Organic Light Emitting Diode (OLED).

8. The system of claim 7, wherein the controller's controlling each current generating circuit further comprises:

during a reset cycle commencing substantially simultaneously with an emission cycle, resetting to a low reference voltage at least one of an anode of the OLED and a terminal of the at least one driving transistor.

9. A method for generating currents for pixels of an emissive display system, each pixel having a light-emitting device, the system comprising a plurality of pixels, a plurality of current generating circuits for providing a current for at least one respective pixel, each current generating circuit comprising at least one driving transistor for providing the current for the pixel, and a storage capacitance for being programmed and for setting a magnitude of the current provided by the at least one driving transistor, the method comprising:

controlling each current generating circuit over a plurality of lines comprising:

charging the storage capacitance to a defined level during a programming cycle; and subsequent to the programming cycle, during a calibration cycle, partially discharging the storage capacitance as a function of characteristics of the at least one driving transistor.

10. The method of claim 9 wherein the at least one driving transistor comprises a driving transistor and controlling each current generating circuit further comprises:

during the programming cycle, charging the storage capacitance connected to a gate terminal of the driving transistor to include at least a threshold voltage of the driving transistor, such that during an emission cycle a voltage across the source terminal and the drain terminal is a function of the threshold voltage of the driving transistor.

11. The method of claim 9 wherein the at least one driving transistor comprises a driving transistor and controlling each current generating circuit further comprises:

during the programming cycle charging the storage capacitance connected to a gate terminal of the driving transistor to include at least a first voltage applied to a source terminal of the driving transistor, such that during an emission cycle, during which a first voltage is maintained at the source terminal of the driving transistor, a voltage across the source terminal and the drain terminal is independent of the first voltage.

12. The method of claim 11, wherein the first voltage is one of $V_{DD}$ and $V_{MON}$.

13. The method of claim 9, wherein each current generating circuit comprises one of a reference current sink and a reference current source for providing the current for the at least one respective pixels, the current provided to provide reference current biasing for the at least one respective pixels.

14. The method of claim 9, wherein each pixel comprises the current generating circuit for providing the current for said pixel, the current provided to drive the light-emitting device of said pixel.

15. The method of claim 14, wherein the light emitting device is an Organic Light Emitting Diode (OLED).

16. The method of claim 15, wherein the controlling each current generating circuit further comprises:

during a reset cycle commencing substantially simultaneously with an emission cycle, resetting to a low reference voltage at least one of an anode of the OLED and a terminal of the at least one driving transistor.

* * * * *